US007984900B2

(12) United States Patent
Terao et al.

(10) Patent No.: US 7,984,900 B2
(45) Date of Patent: Jul. 26, 2011

(54) BUNDLE HOOK DISCHARGE DEVICE

(75) Inventors: Yasunobu Terao, Shizuoka-Ken (JP); Yoshiaki Sugizaki, Shizuoka-Ken (JP); Chiaki Iizuka, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 85 days.

(21) Appl. No.: 12/502,896

(22) Filed: Jul. 14, 2009

(65) Prior Publication Data

US 2010/0013140 A1 Jan. 21, 2010

Related U.S. Application Data

(60) Provisional application No. 61/083,453, filed on Jul. 24, 2008, provisional application No. 61/081,702, filed on Jul. 17, 2008, provisional application No. 61/081,703, filed on Jul. 17, 2008.

(51) Int. Cl.
*B65H 37/04* (2006.01)

(52) U.S. Cl. ..... 270/58.12; 270/58.11; 270/58.08

(58) Field of Classification Search ..... 270/58.08, 270/58.09, 58.11, 58.12, 58.13, 58.14, 58.17
See application file for complete search history.

(56) References Cited

U.S. PATENT DOCUMENTS

| | | | | |
|---|---|---|---|---|
| 6,296,247 | B1 * | 10/2001 | Tamura et al. | 271/214 |
| 6,302,389 | B1 | 10/2001 | Kato et al. | |
| 6,494,449 | B2 * | 12/2002 | Tamura et al. | 271/214 |
| 6,698,744 | B2 * | 3/2004 | Yamada et al. | 270/58.12 |
| 7,207,556 | B2 * | 4/2007 | Saitoh et al. | 270/58.08 |
| 7,413,181 | B2 * | 8/2008 | Iida et al. | 270/58.12 |
| 2007/0057435 | A1 | 3/2007 | Terao et al. | |
| 2007/0063413 | A1 | 3/2007 | Terao et al. | |
| 2007/0065204 | A1 | 3/2007 | Terao et al. | |
| 2007/0138729 | A1 | 6/2007 | Terao et al. | |
| 2007/0252320 | A1 | 11/2007 | Terao et al. | |
| 2008/0054552 | A1 * | 3/2008 | Saito et al. | 271/221 |
| 2008/0099974 | A1 * | 5/2008 | Nomura et al. | 270/58.12 |
| 2009/0057976 | A1 | 3/2009 | Iizuka | |

FOREIGN PATENT DOCUMENTS

| | | | |
|---|---|---|---|
| JP | 5-306052 | A | 11/1993 |
| JP | 10-139256 | A | 5/1998 |
| JP | 11-322178 | A | 11/1999 |
| JP | 2006-306565 | A | 11/2006 |
| JP | 2007-145537 | A | 6/2007 |
| JP | 2008-114966 | A | 5/2008 |

* cited by examiner

*Primary Examiner* — Patrick Mackey

(74) *Attorney, Agent, or Firm* — Patterson & Sheridan, LLP

(57) ABSTRACT

A finisher includes a bundle hook configured to push a sheet bundle in a first direction and convey the sheet bundle; a drive unit configured to drive the bundle hook in the first direction and a second direction; a discharge unit configured to discharge the sheet bundle conveyed by the bundle hook; a stacking unit configured to stack the sheet bundle discharged by the discharge unit; and a control unit configured to control the drive unit to drive the bundle hook in the second direction if the drive unit drives the bundle hook in the first direction and the discharge unit discharges the sheet bundle.

10 Claims, 28 Drawing Sheets

BUNDLE HOOK DISCHARGE DEVICE

CROSS-REFERENCE TO RELATED APPLICATIONS

This application is based upon and claims the benefit of priority from: U.S. provisional application 61/083,453, filed on Jul. 24, 2008; U.S. provisional application 61/081,702, filed on Jul. 17, 2008; and U.S. provisional application 61/081,703, filed on Jul. 17, 2008, the entire contents of each of which are incorporated herein by reference.

TECHNICAL FIELD

The present invention relates to a finisher and an image forming apparatus, and particularly to a finisher which can prevent a sheet jam due to a bundle hook and an image forming apparatus.

BACKGROUND

Recently, an image forming apparatus of an electrophotographic system, such as a laser printer, a digital copying machine or a laser fax, includes a finisher to stitch a sheet bundle. The finisher of the related art includes a stapler to stitch a sheet bundle. The finisher of the related art includes a sheet discharge mechanism to discharge a sheet bundle. The finisher including the sheet discharge mechanism discharges the sheet bundle by a roller and a bundle hook of a drive belt.

However, the finisher can drive the bundle hook of the drive belt only in one direction. There is a problem that if the finisher continues to drive the bundle hook in one direction and the bundle hook returns to a home position of the bundle hook, the bundle hook collides with sheets or sheet bundles which the sheet discharge mechanism discharges and stacks, and an error or a sheet jam is liable to occur.

SUMMARY

It is an object of embodiments to provide a finisher and an image forming apparatus, which can suitably prevent a sheet jam due to a bundle hook.

A finisher described herein includes a bundle hook configured to push a sheet bundle in a first direction and convey the sheet bundle; a drive unit configured to drive the bundle hook in the first direction and a second direction; a discharge unit configured to discharge the sheet bundle conveyed by the bundle hook; a stacking unit configured to stack the sheet bundle discharged by the discharge unit; and a control unit configured to control the drive unit to drive the bundle hook in the second direction if the drive unit drives the bundle hook in the first direction and the discharge unit discharges the sheet bundle.

An image forming apparatus described herein includes an image forming unit configured to form an image on a sheet; a bundle hook configured to push a sheet bundle in a first direction and convey the sheet bundle; a drive unit configured to drive the bundle hook in the first direction and a second direction; a discharge unit configured to discharge the sheet bundle conveyed by the bundle hook; a stacking unit configured to stack the sheet bundle discharged by the discharge unit; and a control unit configured to control the drive unit to drive the bundle hook in the second direction if the drive unit drives the bundle hook in the first direction and the discharge unit discharges the sheet bundle.

DETAILED DESCRIPTION

Hereinafter, embodiments will be described with reference to the drawings.

First Embodiment

Figure 1:
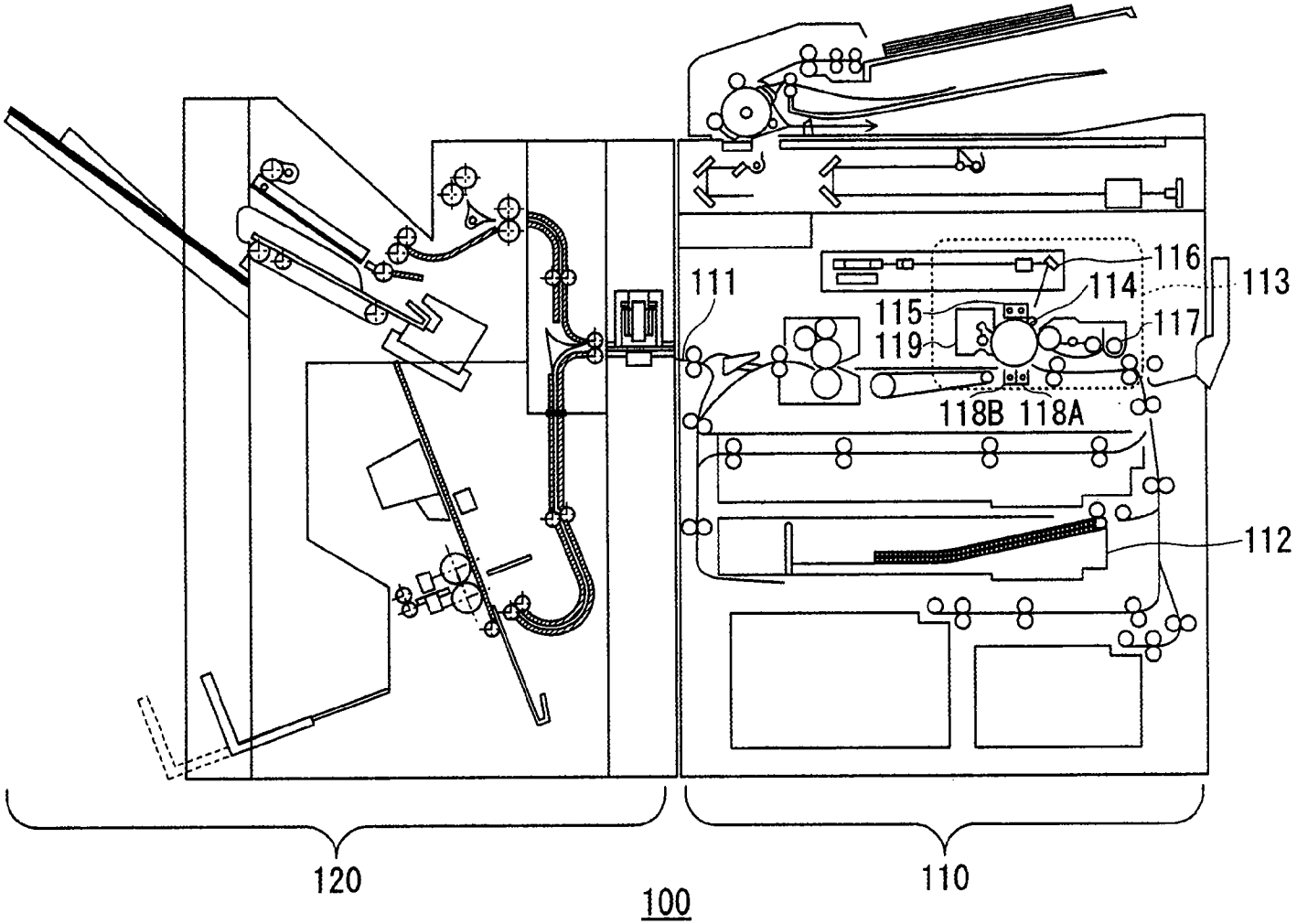
FIG. 1 is a sectional view showing a schematic structure of an image forming apparatus of a first embodiment.

FIG. 1 is a sectional view showing a schematic structure of an image forming apparatus 100 of a first embodiment. The image forming apparatus 100 includes an image forming apparatus main body 110 and a finisher 120. The image forming apparatus main body 110 can form a monochrome image and a color image. The image forming apparatus main body 110 connects to the finisher 120. The image forming apparatus main body 110 includes a sheet housing section 112 to contain sheets, and an image forming section 113 to form an image on a sheet. The image forming section 113 includes a rotatable transfer drum section 114, a charging section 115, an image exposing section 116, a developing section 117, a transfer section 118A, a charge removing section 118B, and a cleaning section 119. The charging section 115, the image exposing section 116, the developing section 117, the transfer section 118A, the charge removing section 118B, and the cleaning section 119 are disposed around the transfer drum 114. The charging section 115 charges the surface of the transfer drum section 114. The image exposing section 116 performs exposing and scanning by a laser. The developing section 117 performs reversal development to form a toner image on the surface of the transfer drum section 114.

The sheet housing section 112 feeds a housed sheet to a conveying path. The sheet fed by the sheet housing section 112 reaches a transfer position in the image forming section 113. The transfer section 118A transfers the toner image to the sheet at the transfer position. The charge removing section 118B removes the electric charge of the sheet. A sheet discharge section 111 discharges the sheet and guides the sheet to the finisher. After the image forming process of the image forming section 113, the cleaning section 119 removes the toner remaining on the surface of the transfer drum section 114.

Figure 2:
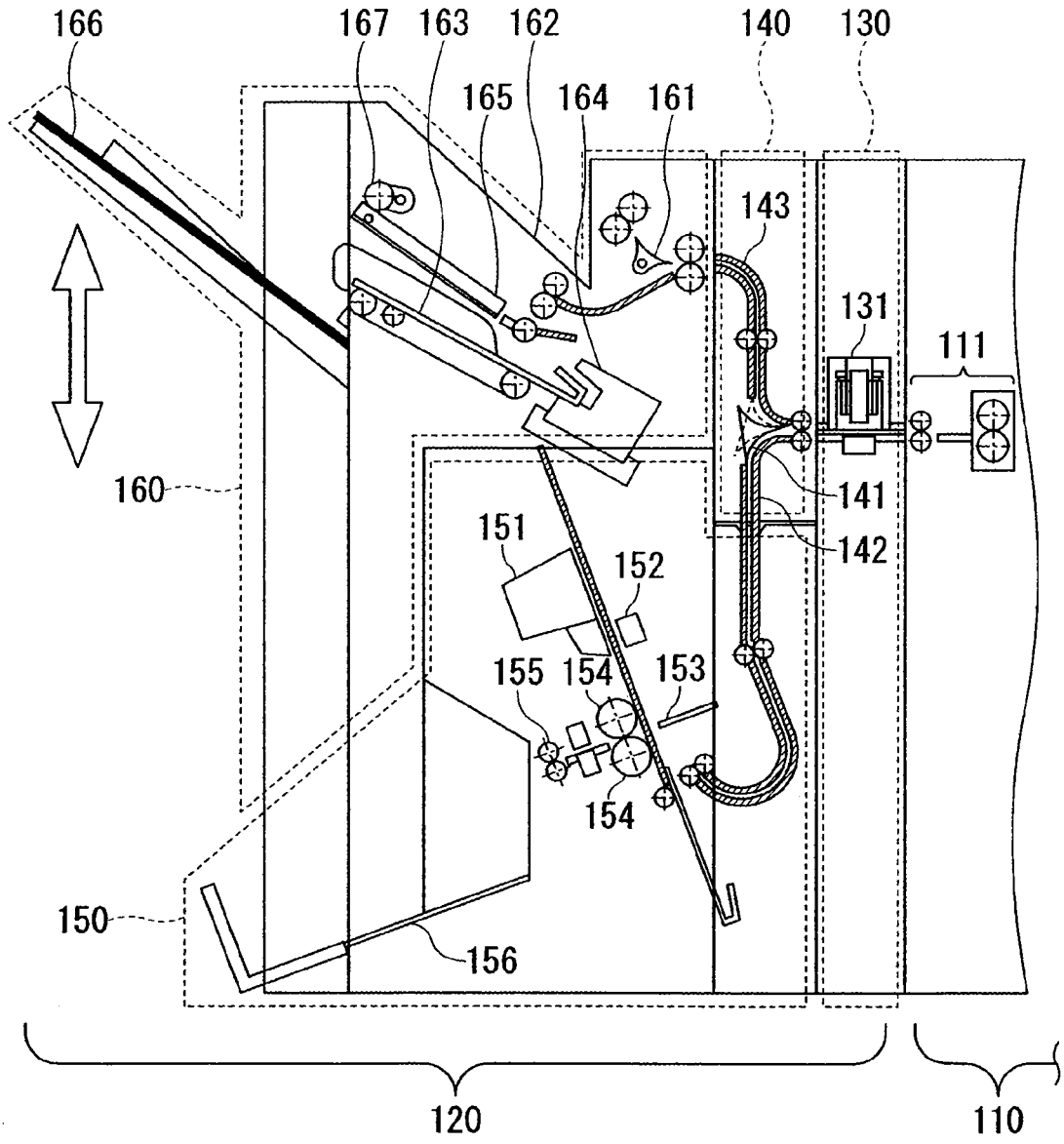
FIG. 2 is an enlarged view of a finisher.

FIG. 2 is an enlarged view of the finisher 120. The finisher 120 includes a puncher section 130 to punch a hole in a sheet bundle, a sheet branching section 140 to distribute a sheet to one of a second finishing section 150 and a first finishing section 160, the second finishing section 150 to perform saddle-stitching and folding, and the first finishing section 160 to stitch the edge of the sheet bundle. The finisher 120 conveys the sheet to the second finishing section 150 or the first finishing section 160 in accordance with an input instruction from an operation panel of the image forming apparatus main body 110 by the user or a print instruction from a personal computer connected to the image forming apparatus 100 through a LAN, and performs finishing on the sheet.

The sheet discharge section 111 includes plural conveying rollers. The sheet discharge section 111 uses the plural conveying rollers to discharge the sheet, and conveys the sheet to the puncher section 130 existing at the downstream side in the sheet conveying direction with respect to the sheet discharge section 111. The puncher section 130 includes a puncher 131. The puncher section 130 uses the puncher 131 to punch a hole in the sheet. The puncher section 130 conveys the sheet to the sheet branching section 140 existing at the downstream side in the sheet conveying direction with respect to the puncher section 130. The sheet branching section 140 includes a branching member 141 to deflect the conveying direction of the sheet, a second conveying path 142 as a sheet conveying path to the second finishing section 150, and a first conveying path 143 as a sheet conveying path to the first finishing section 160.

If the second finishing section 150 folds and saddle-stitches sheets, the second finishing section 150 uses a stapler 151 and an anvil 152 to stitch the center of a sheet bundle at two places. The second finishing section 150 folds the center of the sheet bundle in two by a folding blade 153 and a folding roller 154. The second finishing section 150 discharges the sheet bundle to a standby tray 156 by a discharge roller 155.

On the other hand, if the first finishing section 160 stitches the edge of the sheet bundle, the sheet branching section 140 deflects the conveying direction of the sheet to the first conveying path 143 by the branching member 141, and conveys the sheet bundle to the first finishing section 160. The first finishing section 160 includes a branching member 161 to change the conveying path of a sheet according to a method of finishing, a roof tray 162 to sequentially stack print sheets, a processing tray 163 to stack sheet bundles, a stapler 164 to stitch the sheet bundle, a standby tray 165 to temporarily hold the sheet bundle, and a storage tray 166 to stack the sheet bundle stitched by the first finishing section 160.

If the finisher 120 does not perform finishing other than the punching in the puncher section 130, the sheet branching section 140 deflects the conveying path of the sheet by the branching member 141 and conveys the sheet to the first conveying path 143. The first finishing section 160 deflects the conveying direction of the sheet upward by the branching member 161, and can discharge the sheet to the roof tray 162 by using the conveying roller. Besides, the first finishing section 160 deflects the conveying direction of the sheet downward by the branching member 161, and can discharge the sheet to the storage tray 166 via the standby tray 165.

If the finisher 120 stitches the edge of a sheet bundle without saddle-stitching and folding sheets, the sheet branching section 140 deflects the conveying path of the sheet by the branching section 141, and conveys the sheet to the first conveying path 143. If the finisher 120 sorts sheet bundles without saddle-stitching and folding sheets, the sheet branching section 140 may deflect the conveying path of the sheet by the branching section 141, and convey the sheet to the first conveying path 143. The first finishing section 160 deflects the conveying direction of the sheet downward by the branching member 161, and can discharge the sheet to the standby tray 165 by using the conveying roller.

The standby tray 165 includes a pair of intermediate standby tray parts movable right and left. The standby tray 165 receives a sheet in a state where the pair of intermediate standby tray parts are closed. The standby tray 165 can temporarily hold the sheets sequentially conveyed through the respective conveying paths. The finisher 120 adjusts the flow of sheet conveyance by the holding of the sheets by the standby tray 165, and can secure a time required for the conveyance of the sheets at the downstream side in the sheet conveyance or for the stitching of the edge of the sheet bundle, and can smooth the finishing of the sheets. An intermediate standby tray roller 167 aligns the sheets stored by the standby tray 165.

If the standby tray 165 stores a lager number of sheets than a reference number of sheets, the intermediate standby tray parts are opened. When the intermediate standby tray parts are put in the open state, the sheet bundle drops to the processing tray 163 by own weight of the sheet bundle. A drop assist member can forcibly drop the sheet bundle to the processing tray 163. The processing tray 163 uses an alignment member to align the horizontal and vertical edges.

Figure 3:
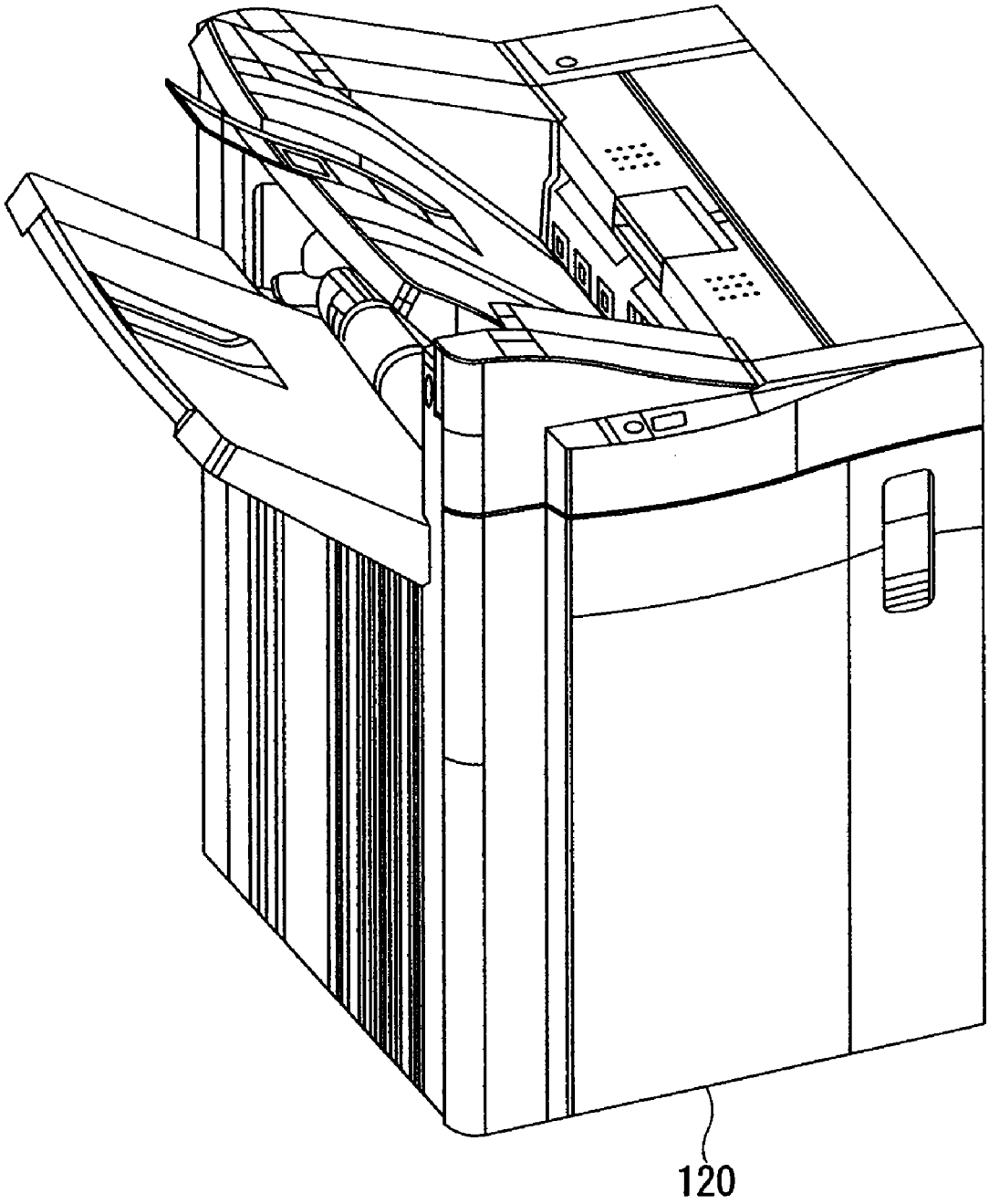
FIG. 3 is an outer appearance perspective view showing a structure of the outer appearance of the finisher.

If the finisher 120 stitches the sheet bundle, the stapler 164 stitches the sheet bundle. The first finishing section 160 discharges and stacks the sheet bundle stitched by the stapler 164 onto the storage tray 166. FIG. 3 is an outer appearance perspective view showing a structure of the outer appearance of the finisher 120.

Figure 4A:
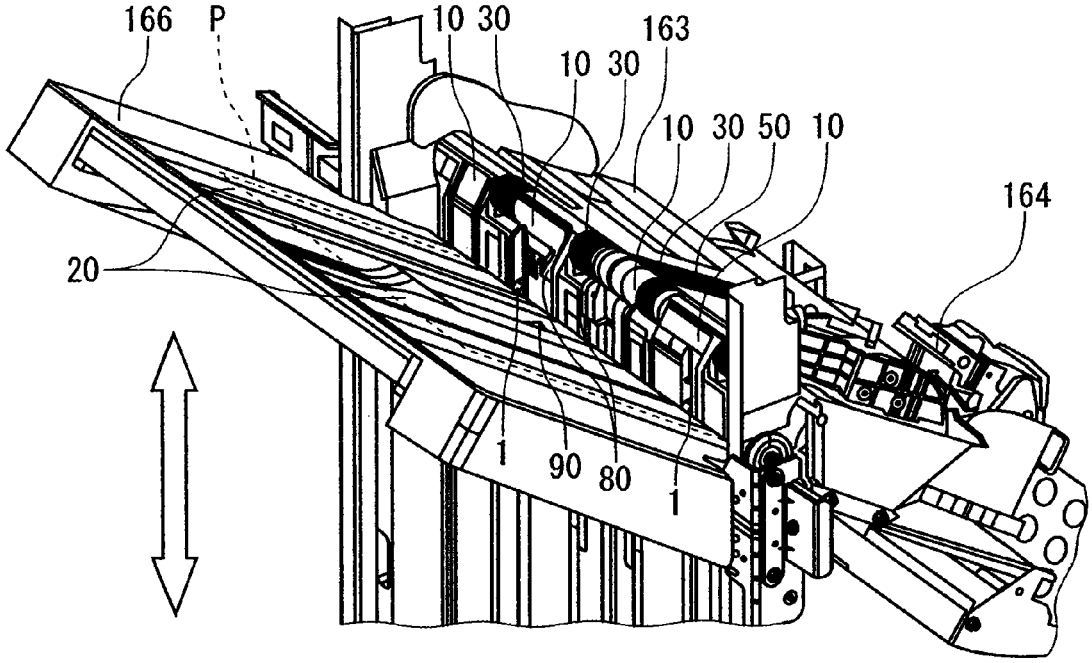
FIG. 4A is a perspective view showing a storage tray of a first finishing section.
Figure 4B:
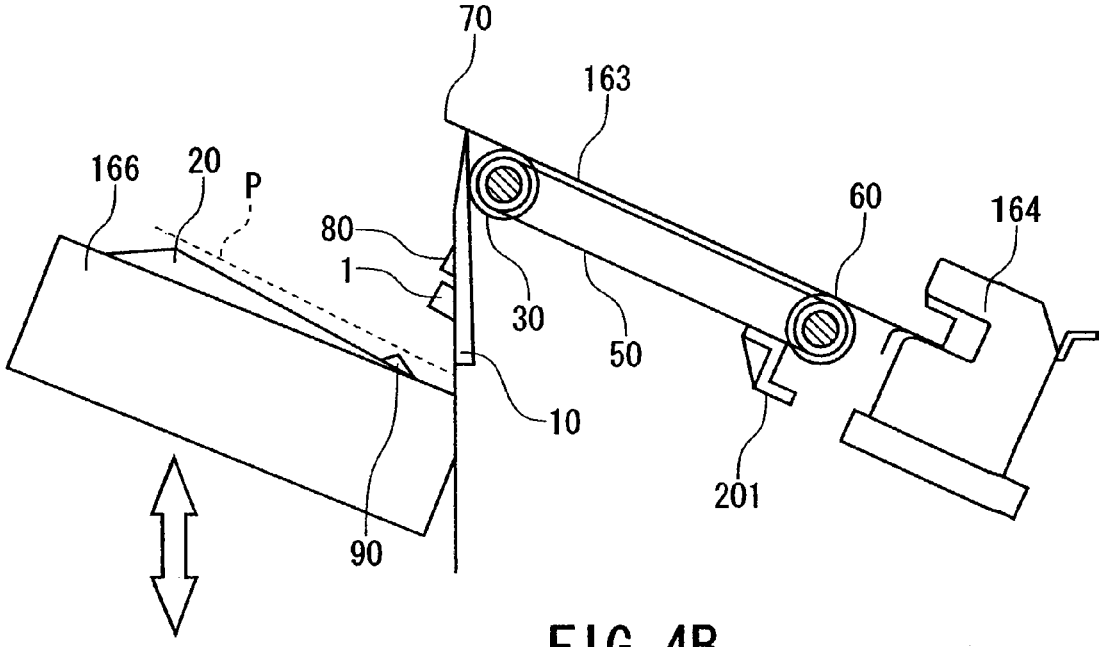
FIG. 4B is a sectional view showing a schematic structure of the storage tray of the first finishing section.

FIG. 4A is a perspective view showing the storage tray 166 of the first finishing section 160. FIG. 4B is a sectional view showing a schematic structure of the storage tray 166 of the first finishing section 160.

A bundle hook belt 50 conveys a sheet on the processing tray 163 to the movable storage tray 166. The bundle hook belt 50 discharges the sheet on the processing tray 163 to the storage tray 166 from a discharge port 70. The storage tray 166 receives the sheet discharged from the discharge port 70 by the bundle hook belt 50. The storage tray 166 is raised and lowered in an outline arrow direction by a drive section. Plural discharge rollers 30 discharge the sheet on the processing tray 163 to the storage tray 166. When the sheet is discharged to the storage tray 166, the discharge rollers 30 are rotated by the drive section. A roller 60 rotates in opposite directions between a case where the sheet on the processing tray 163 is guided to the stapler 164 and a case where the sheet stapled by the stapler 164 is discharged.

The finisher 120 includes a shutter section 10. The shutter section 10 is raised and lowered in the direction parallel to the outline arrow direction independently of the raising and lowering operation of the storage tray 166. The shutter section 10 may be raised and lowered in the direction parallel to the outline arrow direction in synchronization with the raising and lowering operation of the storage tray 166. The shutter section 10 includes plural plate-like members. If the shutter section 10 is raised and lowered, the plural plate-like members are raised and lowered as a unit. The shutter section 10 blocks the sheet after discharged so that the sheet after discharged does not reversely flow to the discharge port 70 when the storage tray 166 moves to a height near the discharge port 70.

The shutter section 10 includes a sheet upper surface detection sensor 80 to detect the uppermost surface of a sheet on the storage tray 166, and a press member 1 to press the edge of a sheet P at the shutter section 10 side. The edge of the sheet P at the shutter section 10 side is defined as "trailing edge of the sheet P". Two plate-like members have the sheet upper surface detection sensor 80. The two plate-like members form the center portion of the shutter section 10. The finisher 120 controls the height of the storage tray 166 in accordance with existence or nonexistence of the sheet based on the detection result of the sheet upper surface detection sensor 80. The shutter section 10 includes a pair of press members 1 so as to nip the pair of the sheet upper surface detection sensors 80.

The storage tray 166 has an inclination angle. The storage tray 166 holds the sheet P on the storage tray 166, and strikes the sheet P against the shutter section 10 to align the sheet P. The storage tray 166 includes a sheet existence detection sensor 90 to detect the existence of the sheet P on the storage tray 166, and a "/\"-shaped rib 20. The sheet existence detection sensor 90 is a weight sensor.

Figure 5:
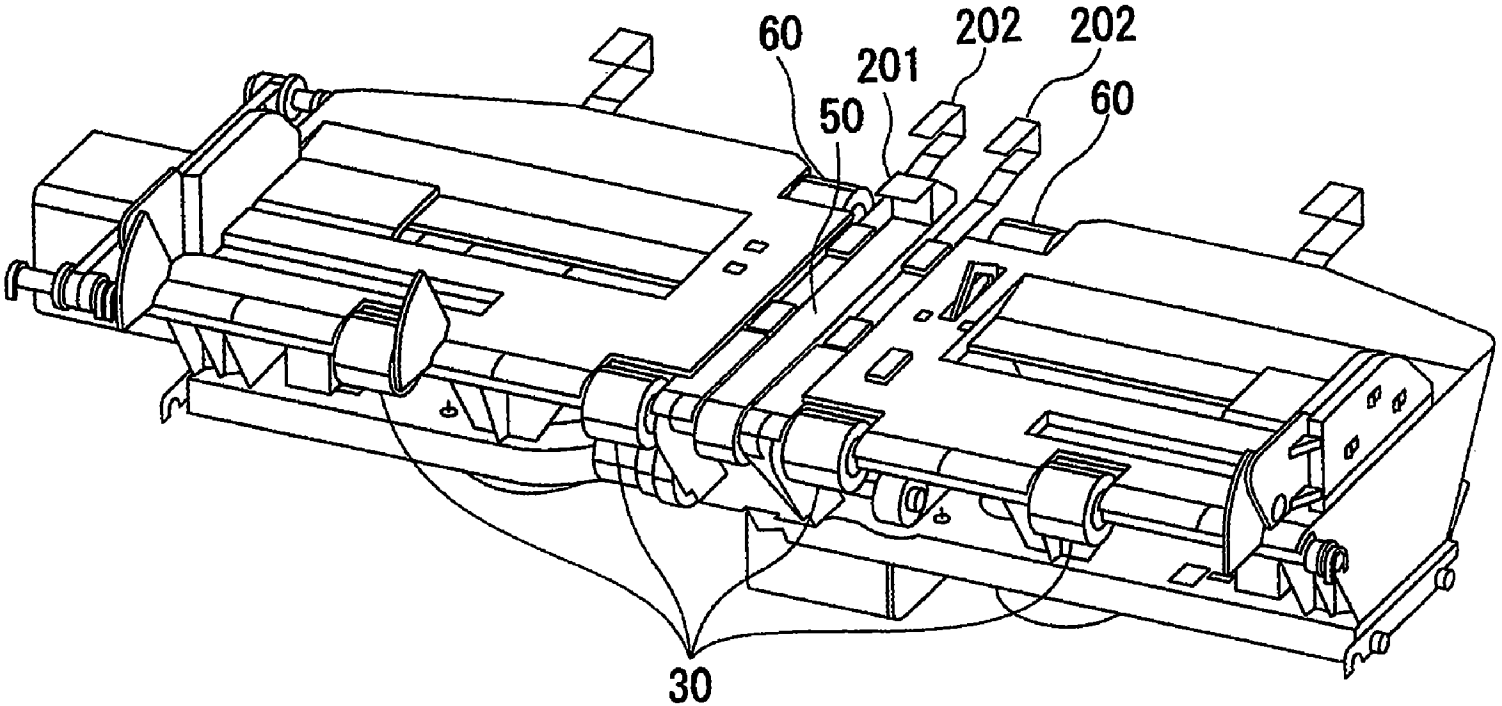
FIG. 5 is a perspective view of the finisher.

FIG. 5 is a perspective view of the finisher 120. As shown in FIG. 5, an ejector 202 includes an eject arm, pushes out a sheet bundle stitched by the stapler 164 toward the direction of the storage tray 166, and delivers the sheet bundle to the bundle hook belt 50. The bundle hook belt 50 includes a bundle hook 201. The bundle hook belt 50 catches the sheet bundle by the bundle hook 201, and discharges the sheet bundle to the storage tray 166 in synchronization with the discharge operation of the discharge rollers 30. A bundle hook motor to drive the bundle hook belt 50 drives the ejector 202 through an electromagnetic clutch. The electromagnetic clutch is turned on, so that the electromagnetic clutch transmits the drive force of the bundle hook motor to the ejector 202.

Figure 6B:
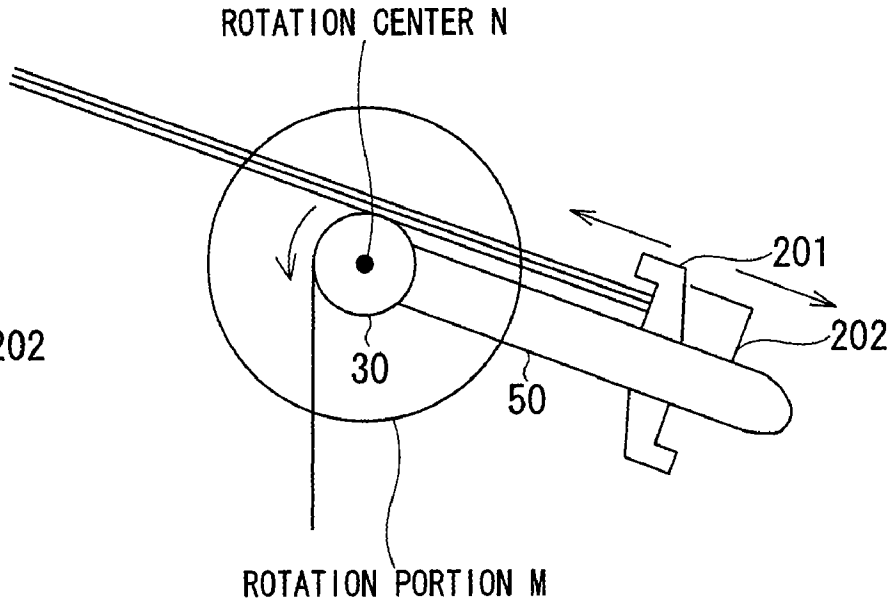
FIGS. 6A and 6B are explanatory views for explaining a discharge operation of a sheet bundle in the finisher.
Figure 6A:
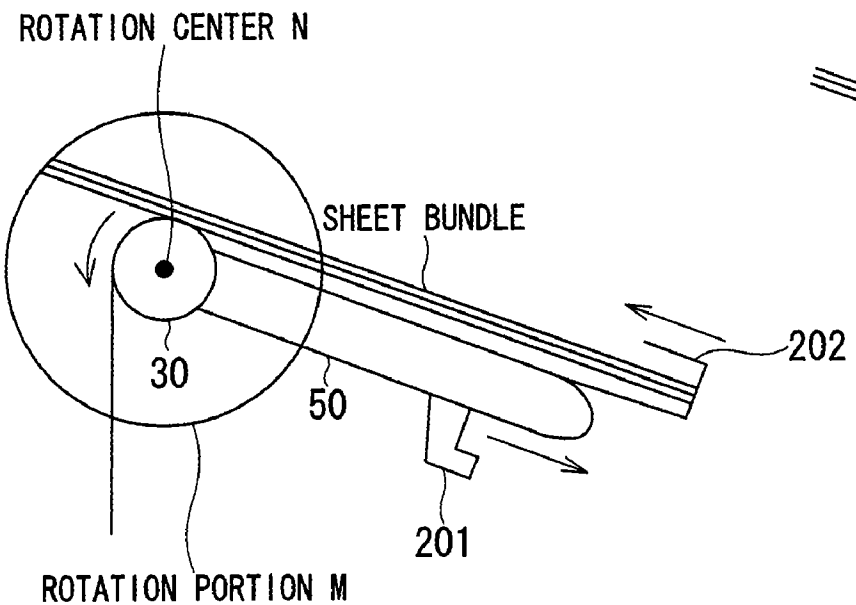

FIGS. 6A and 6B are explanatory views for explaining the discharge operation of the sheet bundle in the finisher. As shown in FIG. 6, if stitching of a sheet bundle is completed, the finisher 120 turns on the electromagnetic clutch and transmits driving to the ejector 202, so that the ejector 202 is driven, and the bundle hook belt 50 and the discharge rollers 30 may be also driven simultaneously. As shown in FIGS. 6A and 6B, the bundle hook 201 of the bundle hook belt 50 overtakes the ejector 202, and receives the sheet bundle from the ejector 202. The bundle hook 201 hooks the sheet bundle, and discharges the sheet bundle to the storage tray 166 in synchronization with the discharge operation of the discharge rollers 30. The bundle hook 201 moves in the reverse direction in order to return to the home position after discharging the sheet bundle. The bundle hook 201 moves in the forward direction in order to return to the home position after discharging the sheet bundle. The bundle hook 201 can move along a curved track spaced from a rotation center N by a distance r. A portion in which the bundle hook 201 is rotated as stated above is defined as "rotation portion M".

Figure 7:
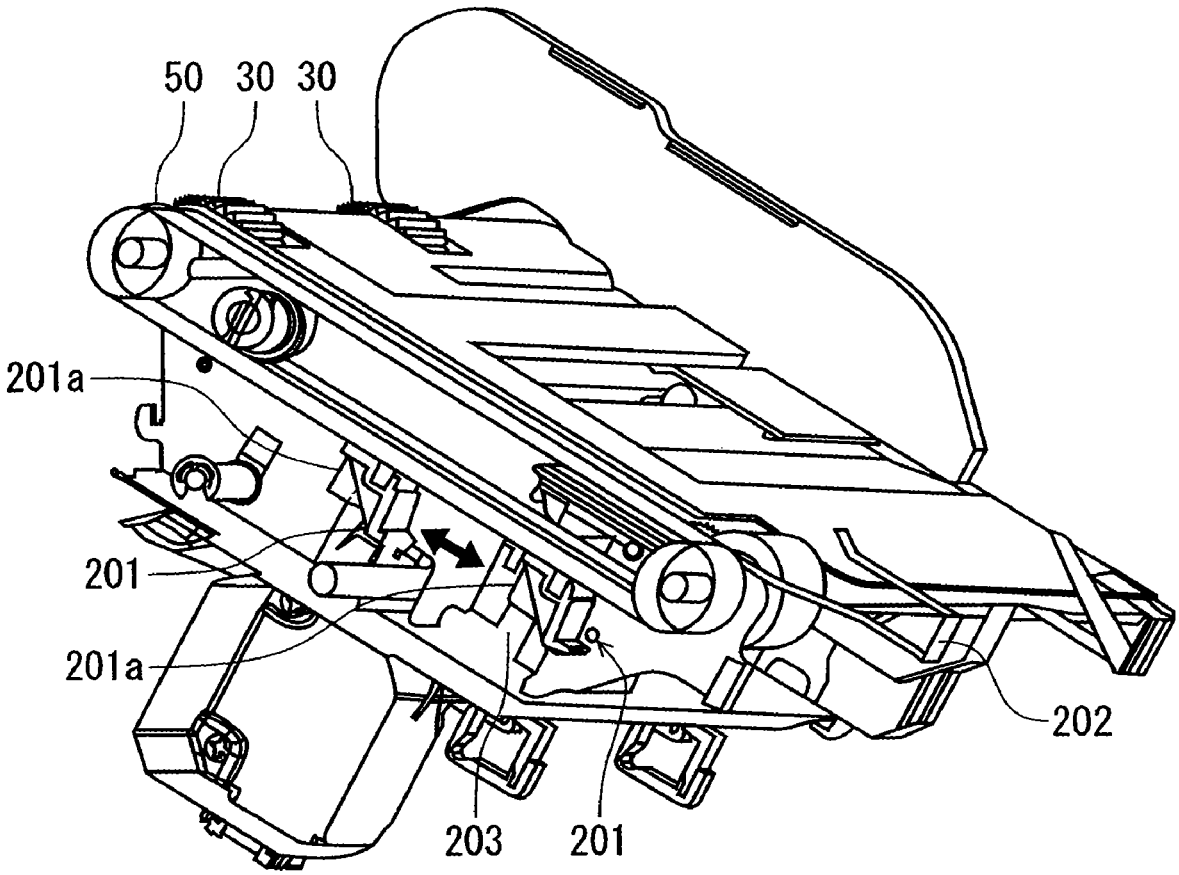
FIG. 7 is a perspective sectional view of a processing tray of the first finishing section.
Figure 8:
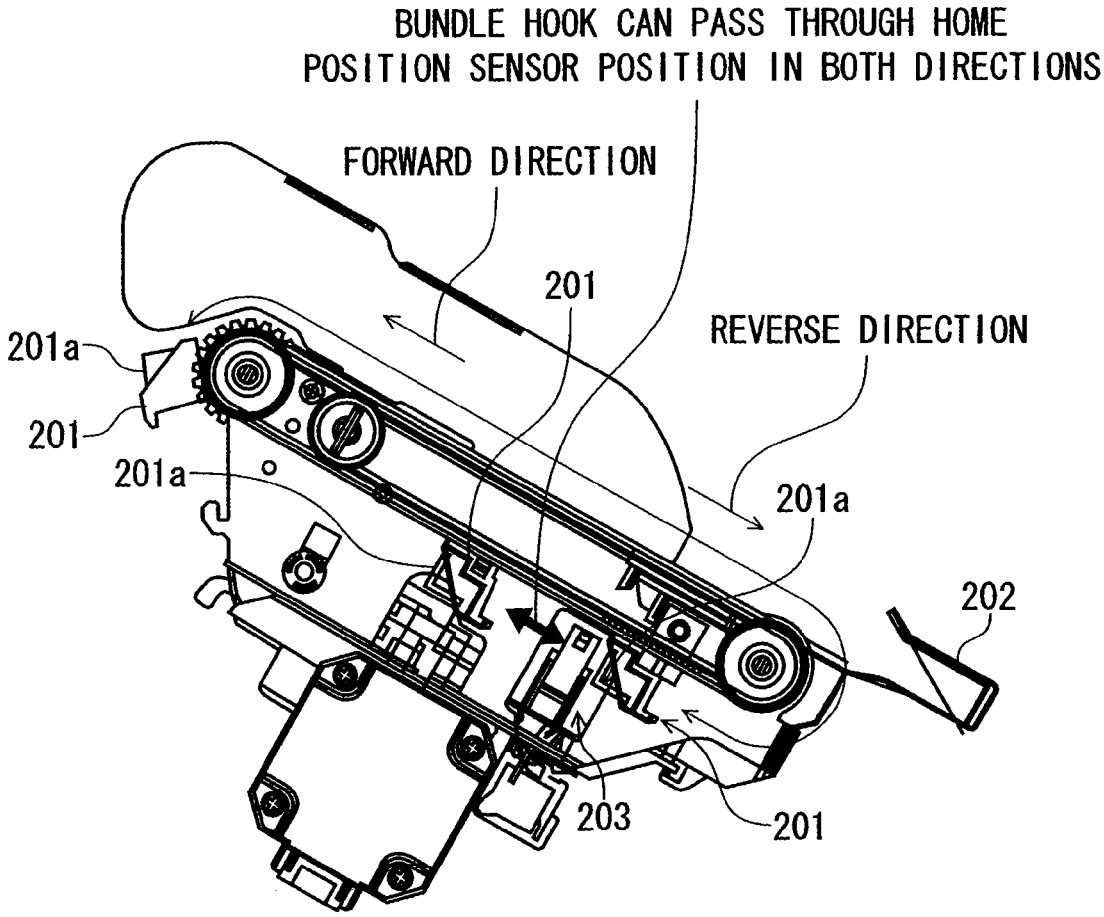
FIG. 8 is a side sectional view of the processing tray of the first finishing section.

FIG. 7 is a perspective sectional view of the processing tray 163 of the first finishing section 160. As shown in FIG. 7, the first finishing section 160 includes a home position sensor 203 to detect whether the bundle hook 201 is located at the home position or not. The home position sensor 203 includes an opening wider than the width of the bundle hook 201. The home position sensor 203 detects a detection plate 201*a* of the bundle hook 201 and detects whether the bundle hook 201 is located at the home position or not. FIG. 8 is a side sectional view of the processing tray 163 of the first finishing section 160. As shown in FIG. 8, the bundle hook 201 can pass through the position of the home position sensor 203 in both the directions. Specially, the bundle hook 201 is moved in the forward direction, and can pass through the position of the home position sensor 203. The bundle hook 201 may be moved in the reverse direction, and pass through the position of the home position sensor 203.

Figure 9:
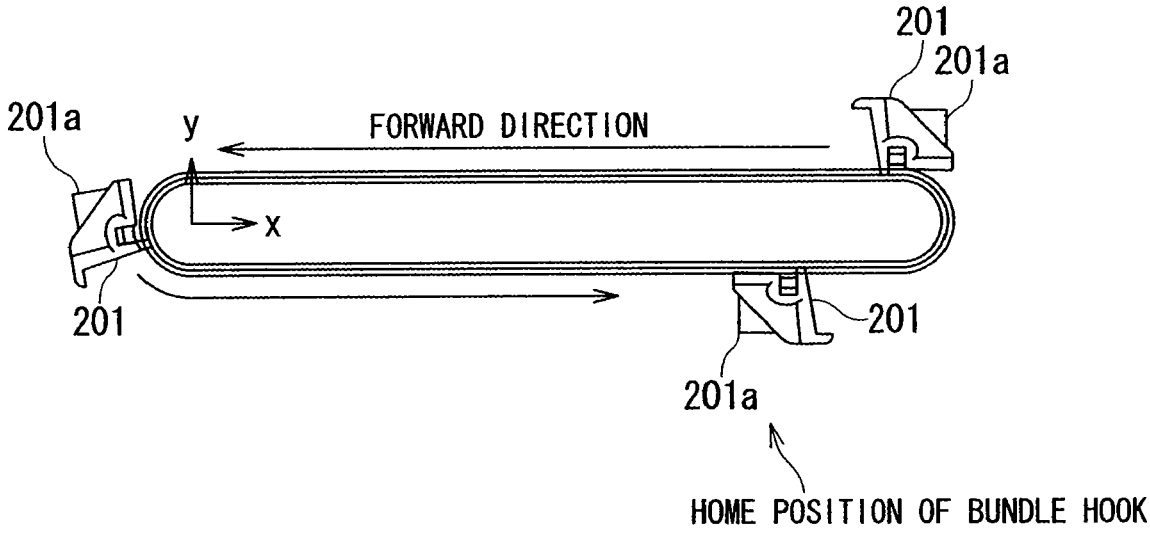
FIG. 9 is a view showing a return operation of a bundle hook in a forward direction to a home position in the related art.
Figure 10:
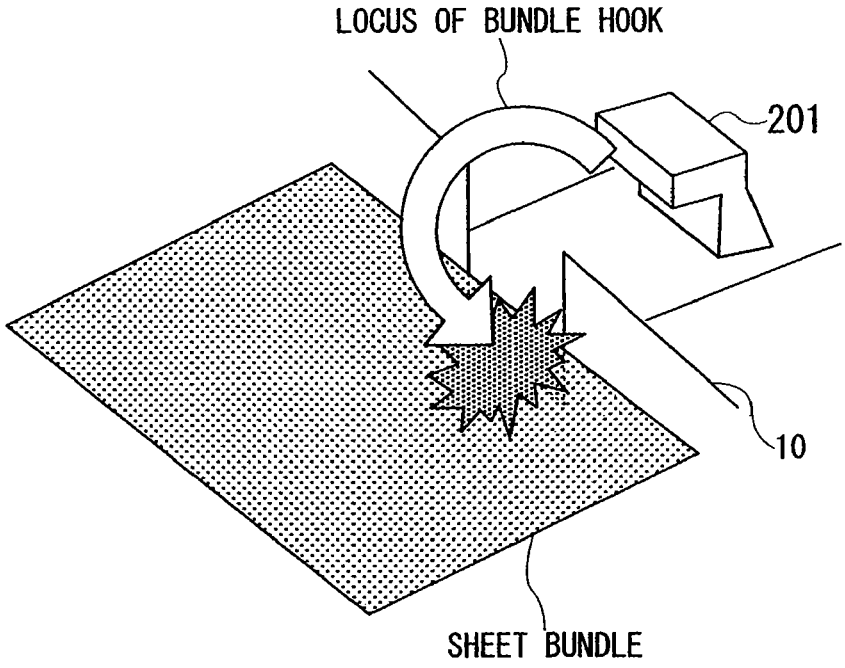
FIG. 10 is a view showing a state where an insufficiently dropped sheet bundle is caught by a bundle hook so that a sheet jam occurs.
Figure 11:
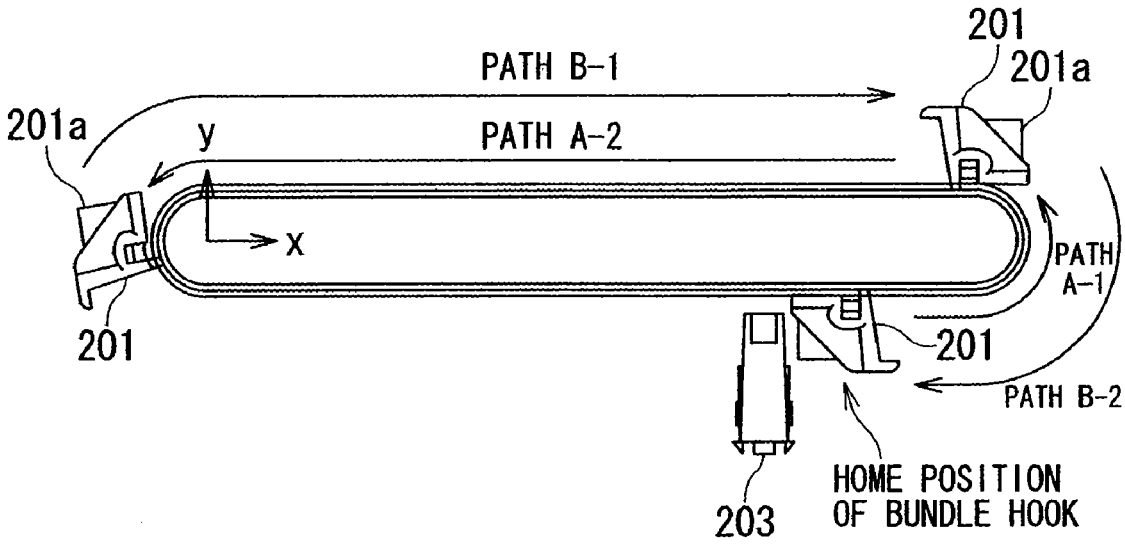
FIG. 11 is a view showing a movement path of the bundle hook in the first embodiment.

In the related art, as shown in FIG. 9, the bundle hook 201 moves in the forward direction to discharge the sheet bundle to the storage tray 166, and then passes through the rotation portion M, and further moves in the forward direction, so that the bundle hook 201 returns to the home position. However, if the finisher 120 discharges the sheet bundle by the bundle hook 201 to the storage tray 166, the trailing edge of the sheet bundle sometimes does not drop to the storage tray 166 due to influences of the friction coefficient of a sheet, the elastic force (stiffness) of the sheet bundle, and the amount of electricity charged on the sheet bundle. FIG. 10 shows a state where an insufficiently dropped sheet bundle is hooked on the bundle hook 201 and a sheet jam occurs. As shown in FIG. 10, if the bundle hook 201 moves in the forward direction after discharging the sheet bundle to the storage tray 166, the insufficiently dropped sheet bundle is hooked on the bundle hook 201, and the sheet jam sometimes occurs. In the first embodiment, after the bundle hook 201 leaves the home position and moves in the forward direction to discharge the sheet bundle to the storage tray 166, the bundle hook 120 moves in the reverse direction and returns to the home position. Since the bundle hook 120 moves in the reverse direction, the finisher 120 can prevent the bundle hook 201 from engaging with the sheet bundle if the bundle hook 201 returns to the home position. FIG. 11 shows a movement path of the bundle hook 201 in the embodiment. As shown in FIG. 11, the bundle hook 201 leaves the home position, moves in the forward direction via paths A-1 and A-2, and discharges the sheet bundle to the storage tray 166. After the bundle hook 201 discharges the sheet bundle to the storage tray 166, the bundle hook 201 moves in the reverse direction and returns to the home position of the bundle hook 201 via paths B-1 and B-2. Hereinafter, a bundle hook belt drive control process by moving of the bundle hook 201 in the reverse direction will be described.

Figure 12:
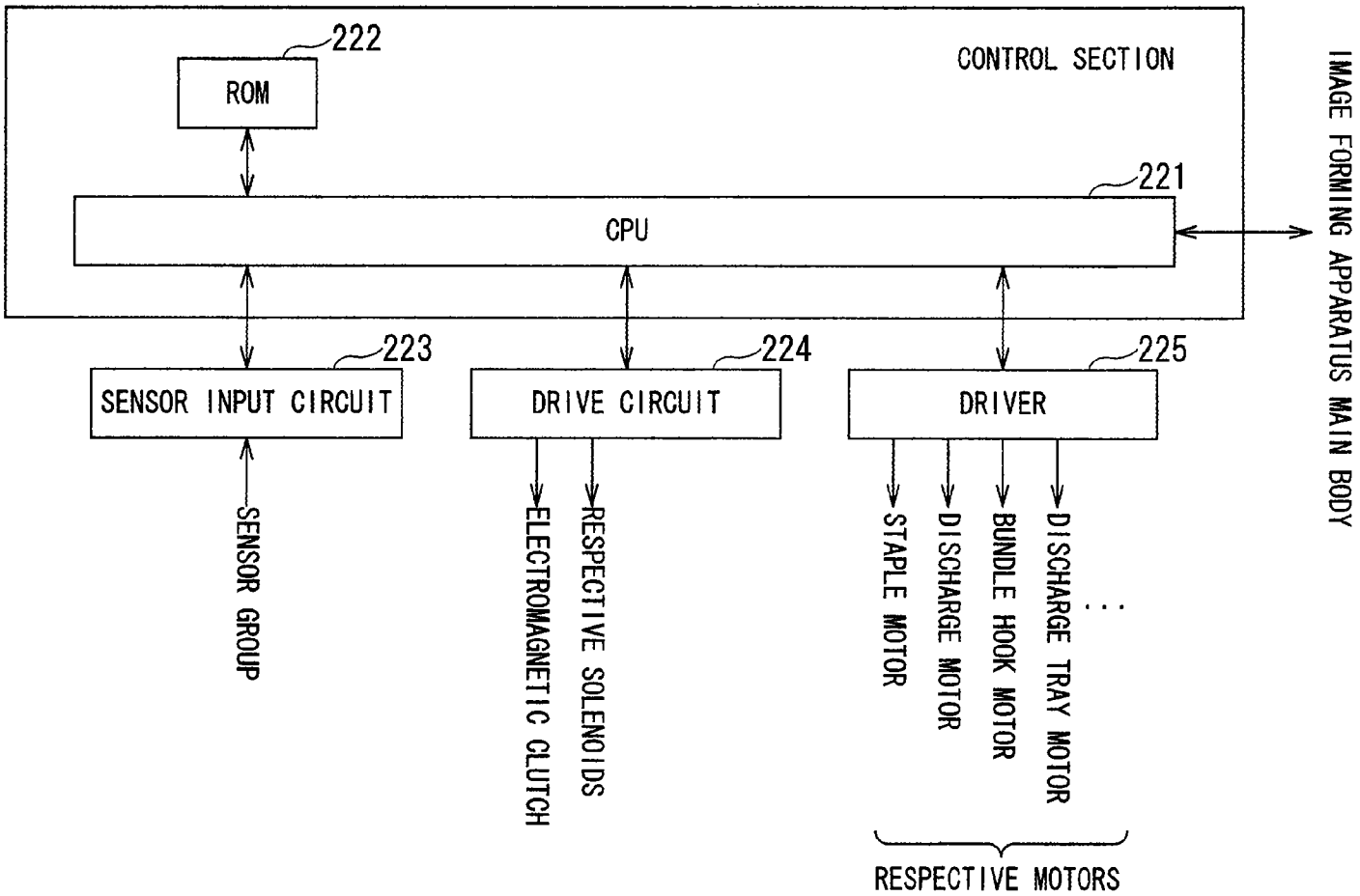
FIG. 12 is a block diagram showing a schematic structure of the inside of a control system of a finisher of the first embodiment.

FIG. 12 shows a schematic structure of the inside of a control system of the finisher 120 of the first embodiment. As shown in FIG. 12, the control system of the finisher 120 includes a CPU (Central Processing Unit) 221, a ROM (Read Only Memory) 222, a sensor input circuit 223, a drive circuit 224, a driver 225, and the like. The CPU 221 executes various processes in accordance with various application programs which the ROM 222 stores, and integrally controls the finisher 120 by generating various control signals to supply to the respective sections. The ROM 222 stores data and the like required when the CPU 221 executes the various processes. The sensor input circuit 223 supplies inputs from a sensor group such as an inlet sensor, a staple home position sensor, a sheet upper surface detection sensor, an upper surface detection sensor, and the home position sensor 203 to the CPU 221. The drive circuit 224 switches on or off the electromagnetic clutch to transmit, for example, the drive force of the bundle hook motor to the ejector 202 in accordance with the control of the CPU 221. Besides, the drive circuit 224 drives respective solenoids in accordance with the control of the CPU 221. The driver 225 drives respective motors in accordance with the control of the CPU 221. A discharge motor is a motor to drive the discharge rollers 30.

The bundle hook belt drive control process of the finisher 120 of the first embodiment will be described with reference to a flowchart of FIG. 13. Incidentally, FIG. 14 is a timing chart of the bundle hook motor and the home position sensor 203 if the finisher 120 executes the bundle hook belt drive control process of FIG. 13.

At Act 1, if the stapler 164 stitches a sheet bundle, the CPU 221 controls the drive circuit 224 and the driver 225, and turns on the electromagnetic clutch at time $t_0$. At Act 2, the CPU 221 controls the drive circuit 224 and the driver 225, and starts to drive the bundle hook motor and the discharge motor in the forward direction in the state where the electromagnetic clutch is on. By driving the bundle hook motor and the discharge motor in the forward direction, the bundle hook 201 starts to move in the forward direction from the home position of the bundle hook 201. At Act 3, the CPU 221 controls the driver 225, drives the bundle hook motor and the discharge motor in the forward direction, and drives the bundle hook belt 50 and the discharge rollers 30 at respective drive speeds in the forward direction. At Act 4, the bundle hook 201 of the bundle hook belt 50 is driven in accordance with the control of the CPU 221, and reaches a straight path after rotation movement. The bundle hook 201 of the bundle hook belt 50 overtakes the ejector 202, and receives the sheet bundle from the ejector 202. At Act 5, the CPU 221 controls the drive circuit 224 and the driver 225, and turns off the electromagnetic clutch after the bundle hook 201 receives the sheet bundle. The finisher 120 does not drive the ejector 202 by turning off the electromagnetic clutch an the bundle hook 201 overtakes the ejector 202

At Act 6, the CPU 221 controls the driver 225, accelerates the bundle hook belt 50 and the discharge rollers 30 stepwise after the bundle hook belt 50 receives the sheet, and drives the bundle hook belt 50 and the discharge rollers 30 at respective drive speeds in the forward direction. At Act 7, the CPU 221 controls the driver 225, and uses the bundle hook 201 of the bundle hook belt 50 and the discharge rollers 30 at time $t_1$ and discharges the sheet bundle to the storage tray 166. At Act 8, the CPU 221 controls the driver 225, stops the driving of the bundle hook motor at time $t_2$, and once stops the driving of the bundle hook belt 50 from time $t_2$ to time $t_3$. At Act 9, the CPU 221 controls the driver 225, drives the bundle hook motor in the reverse direction at time $t_3$, and drives the bundle hook 201 of the bundle hook belt 50 to the home position of the bundle hook 201. At Act 10, the home position sensor 203 which exists in the home position of the bundle hook 201 detects that the bundle hook 201 reaches the home position of the bundle hook 201 at time $t_4$. That is, the home position sensor 203 which exists in the home position of the bundle hook 201 detects that the detection plate 201*a* of the bundle hook 201 reaches the home position of the bundle hook 201 at time $t_4$, and consequently detects that the bundle hook 201 reaches the home position of the bundle hook 201. If the home position sensor 203 detects that the bundle hook 201 reaches the home position of the bundle hook 201, at Act 11, the CPU 221 controls the driver 225, stops the driving of the bundle hook motor at time $t_5$, and once stops the driving of the bundle hook belt 50 from time $t_5$ to time $t_6$. At Act 12, the CPU 221 controls the driver 225, drives the bundle hook motor in the forward direction at time $t_6$, and performs positioning of the home position of the bundle hook 201. Specifically, the CPU 221 controls the driver 225 to drive the bundle hook motor in the forward direction at time $t_6$, uses the home position sensor 203 to detect the position of the detection plate 201*a* of the bundle hook 201, and moves the position of the bundle hook 201 to the home position. By the bundle hook 201 moving to the home position, the finisher 120 can perform a following sheet bundle discharge operation. At Act 13, when the positioning of the home position of the bundle hook 201 is ended, the CPU 221 controls the driver 225, stops the driving of the bundle hook motor at time $t_7$, and stops the driving of the bundle hook belt.

In the finisher 120 of the first embodiment, it is possible to prevent that the bundle hook 201 engages with the sheet bundle when returning to the home position. Besides, in the finisher 120 of the first embodiment, since the transmission sensor having the width wider than the bundle hook 201 detects the position of the bundle hook 201, it is possible to prevent the detection plate 201*a* from protruding to the outside of the traveling area of the bundle hook 201, and it is possible to prevent that the sheet conveyance is disturbed by the movement of the bundle hook 201. Especially, in the finisher 120 of the first embodiment, a non-contact transmission sensor (home position sensor 203) having a width wider than the bundle hook 201 detects the position of the bundle hook 201, and the bidirectional operation of the bundle hook 201 can be detected.

Figure 13:
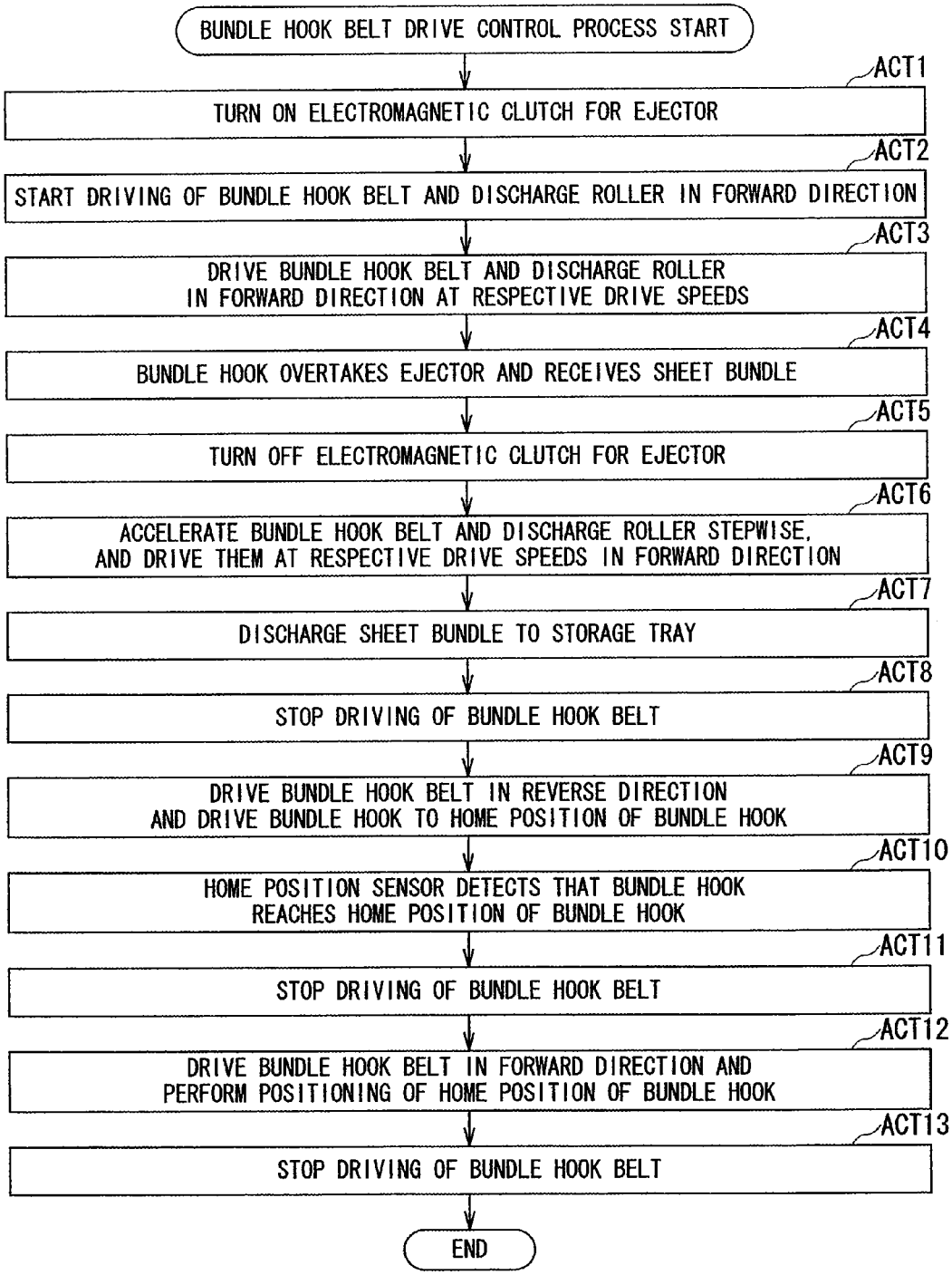
FIG. 13 is a flowchart for explaining a bundle hook belt drive control process in the finisher of the first embodiment.
Figure 14:
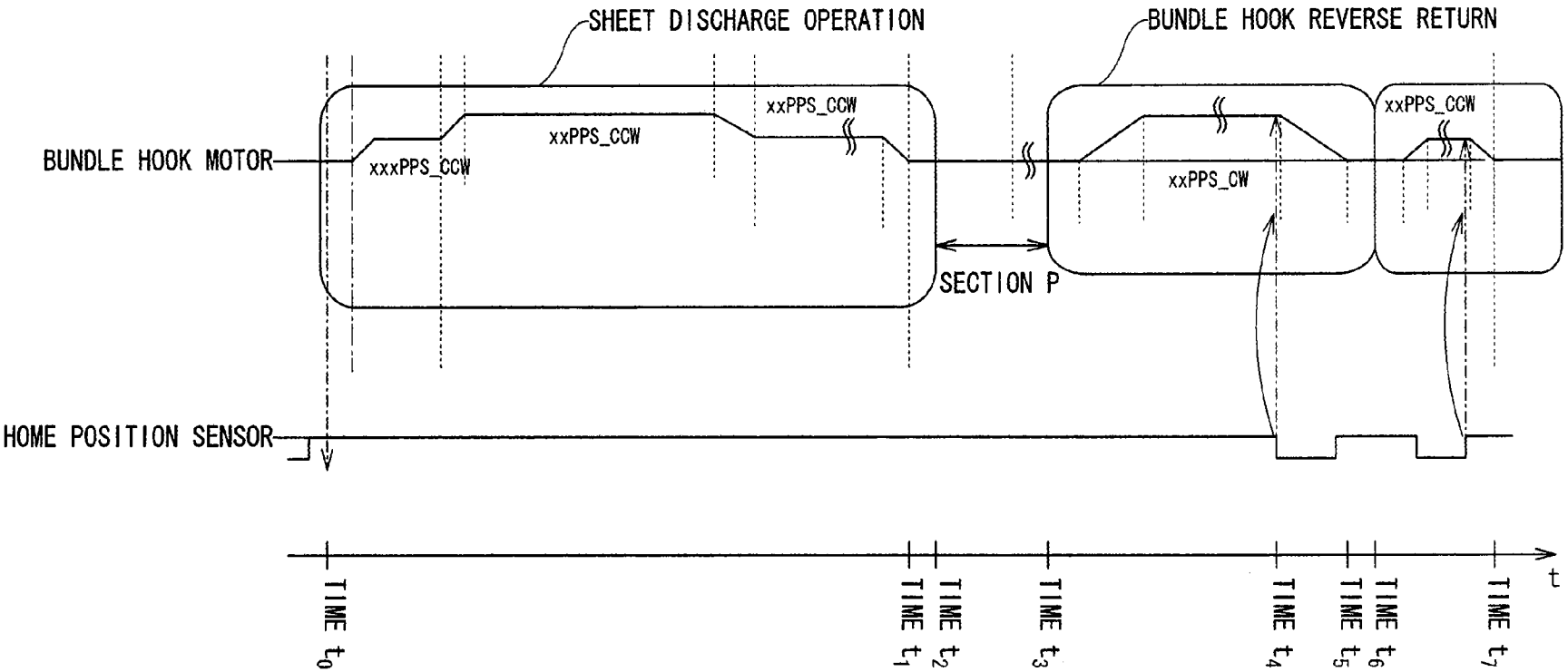
FIG. 14 is a timing chart of a bundle hook motor and a home position sensor if the finisher executes the bundle hook belt control process of FIG. 13.

The bundle hook belt drive control process using the detection of the home position sensor 203 of FIG. 13 may be performed at each time of the discharge operation of the sheet bundle. If the user touches the sheet by the user's hand at the time of discharge of the sheet bundle, or the trailing edge of the sheet remains by some cause, the bundle hook motor is liable to lose synchronization when the bundle hook 201 pushes out the sheet or the sheet bundle. However, in the finisher 120 of the embodiment, since the bundle hook belt drive control process using the detection by the home position sensor 203 is performed at each time of the discharge operation of the sheet bundle, a sheet jam is prevented, the loss of synchronization of the bundle hook motor can be prevented, and the print job can be continued without causing an error.

Incidentally, as shown in the timing chart of FIG. 14, in the bundle hook belt drive control process of FIG. 13, at Act 8, the finisher 120 stops the driving of the bundle hook belt 50 in the section P. However, no limitation is made to such a case. That is, in the finisher 120 of the first embodiment, the section P is not provided, and the reverse return operation of the bundle hook may be performed immediately after the discharge of the sheet bundle. In the finisher 120 of the first embodiment, the series of processing times relating to the discharge operation of the sheet bundle can be shortened by the portion of the section P.

Figure 15:
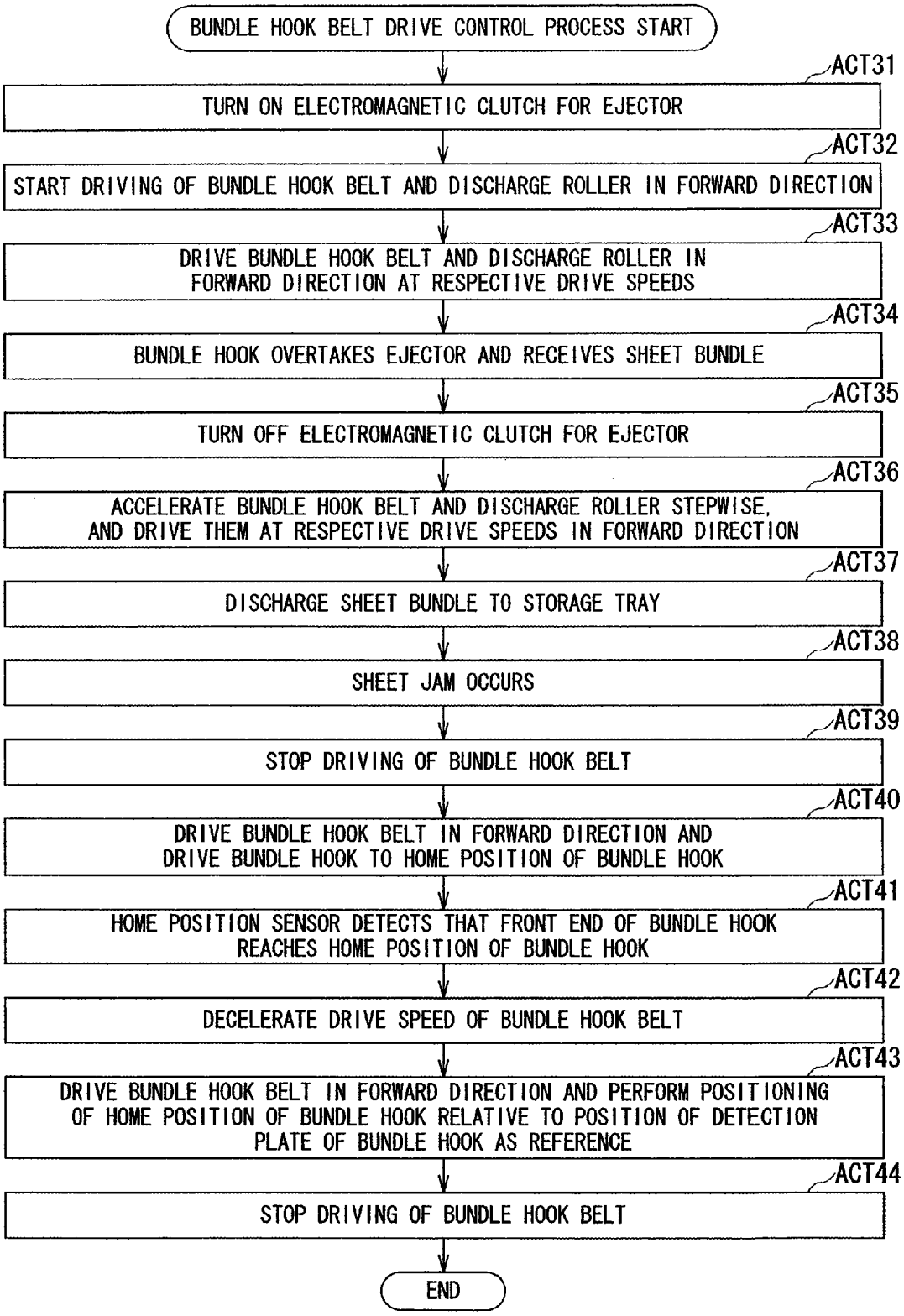
FIG. 15 is a flowchart for explaining another bundle hook belt drive control process in the finisher of the first embodiment.

Besides, when a sheet jam occurs during the print job, there is a possibility that a sheet remains on the processing tray 163. When the sheet remains on the processing tray 163, when the finisher 120 moves the bundle hook 201 in the reverse direction and returns it to the home position of the bundle hook 201, the bundle hook 201 damages the sheet on the processing tray 163. If the sheet jam occurs during the print job, the finisher 120 moves the bundle hook 201 in the forward direction to return it to the home position of the bundle hook 201, and performs positioning of the home position. FIG. 15 shows a bundle hook belt drive control process in a case where the sheet jam occurs during the print job, the finisher 120 moves the bundle hook 201 in the forward direction to return it to the home position of the bundle hook 201, and performs positioning of the home position.

Figure 16:
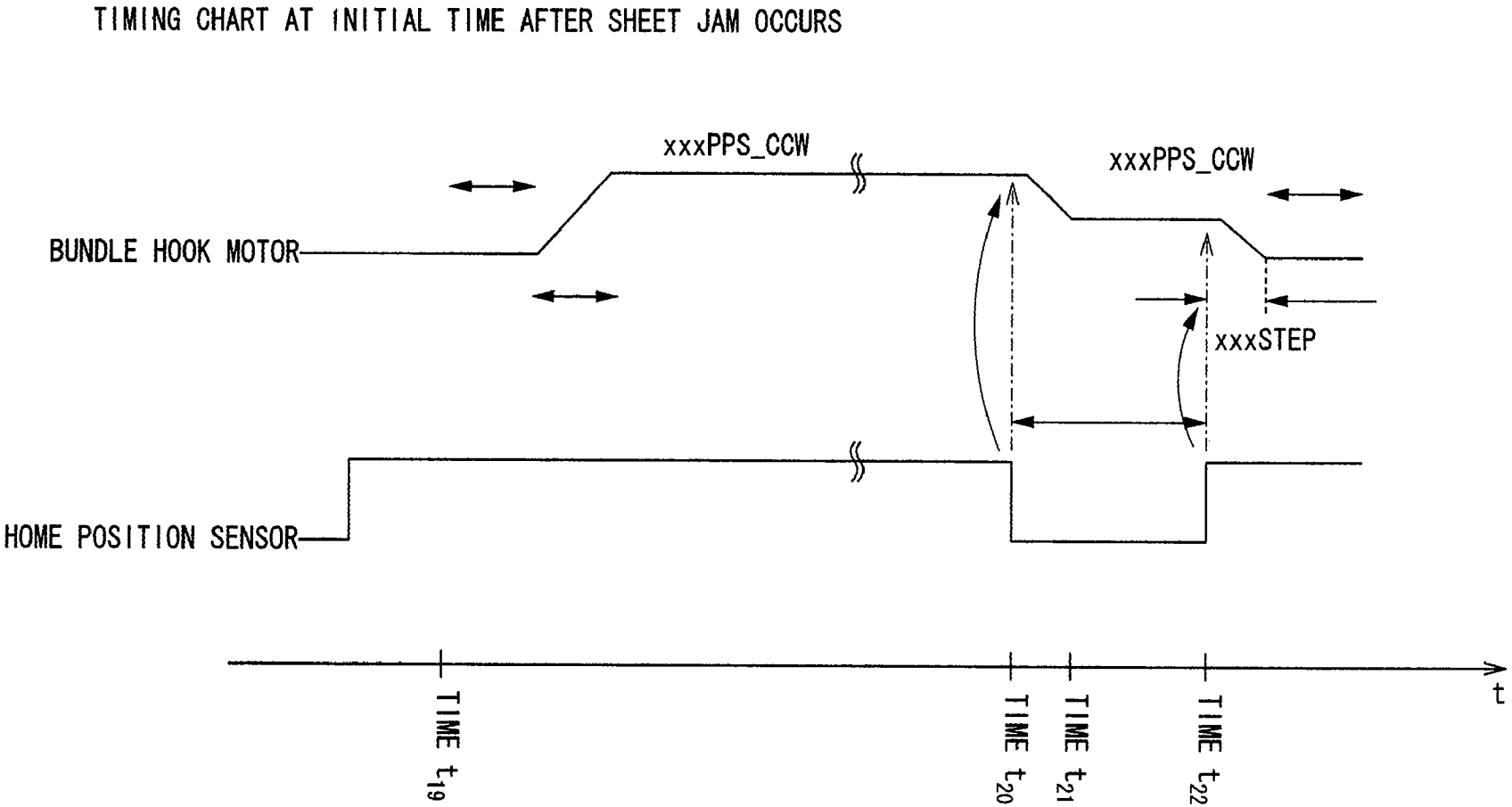
FIG. 16 is a timing chart of a bundle hook motor and a home position sensor if the finisher executes the bundle hook belt drive control process of FIG. 15.

Another bundle hook belt drive control process in the finisher 120 of the first embodiment will be described with reference to the flowchart of FIG. 15. Incidentally, FIG. 16 is a timing chart of the bundle hook motor and the home position sensor 203 when the bundle hook belt drive control process of FIG. 15 is executed. In the case of FIG. 15, although a sheet jam occurs at Act 38, since Act 31 to Act 37 before the occurrence of the sheet jam are the same as Act 1 to Act 7 of FIG. 13, the description about Act 1 to Act 7 is omitted to avoid repetition.

At Act 38, the sheet jam occurs. At Act 39, the CPU 221 controls the driver 225, stops driving of the bundle hook motor, and once stops driving of the bundle hook belt 50. At Act 40, the CPU 221 controls the driver 225, drives the bundle hook motor in the forward direction at time $t_{19}$, and drives the bundle hook 201 of the bundle hook belt 50 to the home position of the bundle hook 201. At Act 41, the home position sensor 203 detects that the front end of the bundle hook 201 reaches the home position of the bundle hook 201 at time $t_{20}$. If the home position sensor 203 detects that the front end of the bundle hook 201 reaches the home position of the bundle hook 201, At Act 42, the CPU 221 controls the deriver 225, reduces the drive speed of the bundle hook motor at time $t_{21}$, and reduces the drive speed of the bundle hook belt 50. At Act 43, the CPU 221 controls the driver 225, drives the bundle hook motor in the forward direction at time $t_{22}$, uses the home position sensor 203 to detect the position of the detection plate 201*a* of the bundle hook 201, and moves the position of the bundle hook 201 to the home position. By the bundle hook 201 moving to the home position, the finisher 120 can perform a following sheet bundle discharge operation. At Act 44, when the positioning of the home position of the bundle hook 201 is ended, the CPU 221 controls the driver 225, stops the driving of the bundle hook motor, and stops the driving of the bundle hook belt.

In the finisher 120 of the first embodiment, in both the positioning of the home position of the bundle hook 201 in the forward direction and the positioning of the home position of the bundle hook 201 in the reverse direction, the influence due to a backlash and the like of the driving section such as the bundle hook motor can be eliminated, and in both the cases, the positioning of the home position under the same condition can be performed. Besides, in the case of the positioning of the home position in the reverse direction, for shortening a processing time and eliminating a superfluous operation, the finisher 120 sets a distance between the detection position of the home position sensor and the bundle hook stop position to be as short as possible. However, when the finisher 120 sets the distance between the detection position of the home position sensor and the bundle hook stop position to be as short as possible, in the case of the positioning of the home position in the forward direction, since a certain degree of distance is required for reduction of the drive speed of the bundle hook belt 50, in the finisher 120 of the first embodiment, the drive speed of the bundle hook belt 50 starts to be reduced previously at a position of the front end of the bundle hook. Thus, also in the positioning of the home position in the forward direction, the positioning of the home position under the same condition as that in the positioning of the home position in the reverse direction can be performed.

If receiving a load of a sheet bundle, a push-out surface of the bundle hook 201 to push out a sheet is inclined rearward in the traveling direction since the bundle hook belt 50 sags, and in view of this, the push-out surface of the bundle hook 201 is inclined forward in the traveling direction. The push-out surface of the bundle hook 201 can have a step. Since the push-out surface of the bundle hook 201 is inclined forward in the traveling direction, if the home position sensor 203 detects the position of the bundle hook 201, it becomes difficult that the home position sensor 203 detects the front end of the bundle hook 201 and detects the position of the bundle hook 201. However, in the finisher 120 of the first embodiment, the home position sensor 203 detects the detection surface of the bundle hook 201, and detects the position of the bundle hook 201. Accordingly, in the finisher 120 of the first embodiment, the position of the bundle hook 201 can be detected at high precision.

The home position sensor 203 may be a transmission sensor or an actuator sensor.

Second Embodiment

When the bundle hook 201 performs a discharge operation of a sheet bundle after stapling, basically, the bundle hook 201 discharges the sheet bundle at the same discharge speed, and stops at the same stop position when discharging the sheet bundle. However, in order to avoid remaining of the trailing edge of the sheet bundle after stapling, the finisher 120 sets the discharge speed of the sheet bundle after stapling to be higher than a reference value, and discharges the sheet bundle after stapling to a position more separate from the shutter section 10 on the storage tray 166. By discharging the sheet bundle after stapling to a position more separate from the shutter section 10 on the storage tray 166, in the finisher 120, the sheet bundle after stapling slides down to the shutter section 10 side by its own weight along the inclination of the storage tray 166, and the sheet bundle after stapling can be aligned to the wall of the shutter section 10.

Figure 17:
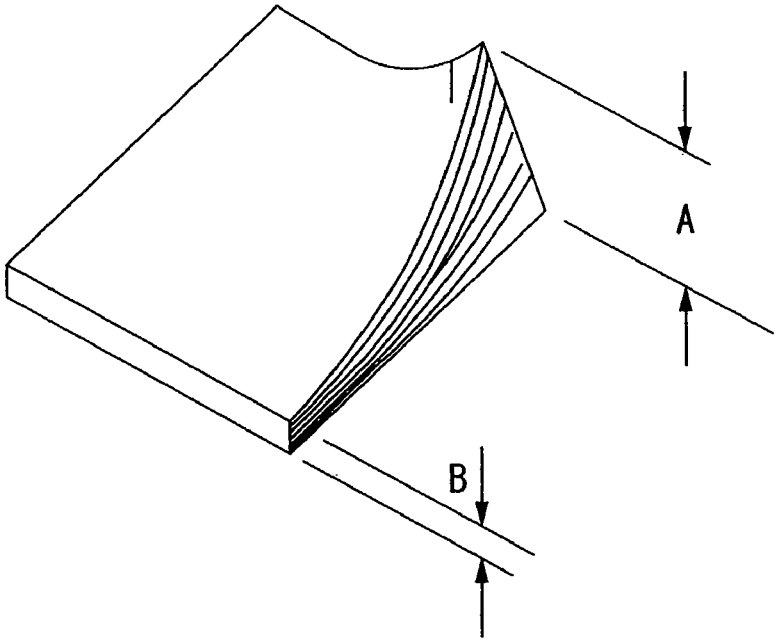
FIG. 17 is a view showing the bulging of sheets by an increase in the number of stacked sheet bundles after stapling.
Figure 18:
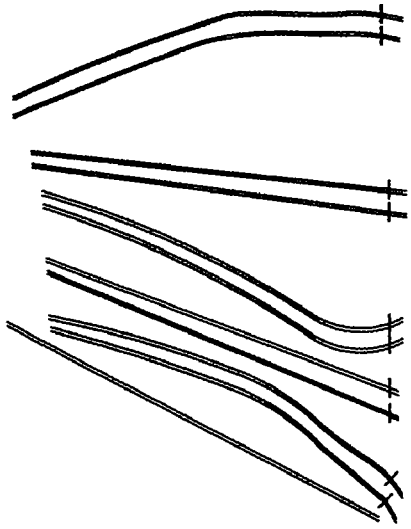
FIG. 18 is a view showing a state of sheet bundles on a storage tray if a stapler staples the sheet bundle at two places.

However, if the finisher 120 sequentially stacks the sheet bundle after stapling on the storage tray 166, and the number of stacked sheet bundles after stapling is increased, in the finisher 120, when the sheet bundles after stapling are excessively discharged to the position separate from the shutter section 10 on the storage tray 166, the sheet bundles after stapling can not return to the wall of the shutter section 10, and the finisher 120 stacks the sheet bundles after stapling stepwise. FIG. 17 shows bulging of the sheets by an increase in the number of stacked sheet bundles after stapling. As shown in FIG. 17, when the number of processed sheets of the sheet bundle stapled by the stapler 164 is small, the portions of staple needles are stacked, and thickness A of a sheet bundle group at the side where the stapler 164 staples a sheet bundle group becomes larger as compared with thickness B of a sheet group at the side where the stapler 164 staples a sheet bundle group. FIG. 18 shows a state of sheet bundles on the storage tray 166 when the stapler 151 staples the sheet bundle at two places. If the stapler 151 staples the sheet bundle at two places, when the number of stacked sheet bundles after stapling is increased, an angle at which the sheet bundle enters the storage tray 166 becomes small, and in an extreme case, the sheet bundle has an inclination opposite to the shutter section 10 side on the storage tray 166. Then, the sheet bundle slides down in the opposite direction to the shutter section 10 side.

In the finisher 120 of the second embodiment, the stop position of the bundle hook 201 at the time of discharging the sheet bundle is set to be different between a case where the number of stacked sheet bundles after stapling is a reference value or less and a case where the number of stacked sheet bundles after stapling is larger than the reference value. In the second embodiment, since the structures of FIG. 1 to FIG. 12 are not changed, their description is omitted to avoid repetition. Besides, it is assumed that the finisher 120 of the second embodiment executes the bundle hook belt drive control process shown in FIG. 13 similarly to the first embodiment. The finisher 120 of the second embodiment may execute the bundle hook belt drive control process shown in FIG. 15 similarly to the first embodiment. Of course, the finisher 120 of the second embodiment can be applied to the case where the bundle hook belt drive control process shown in FIG. 13 and FIG. 15 is not executed.

Figure 19A:
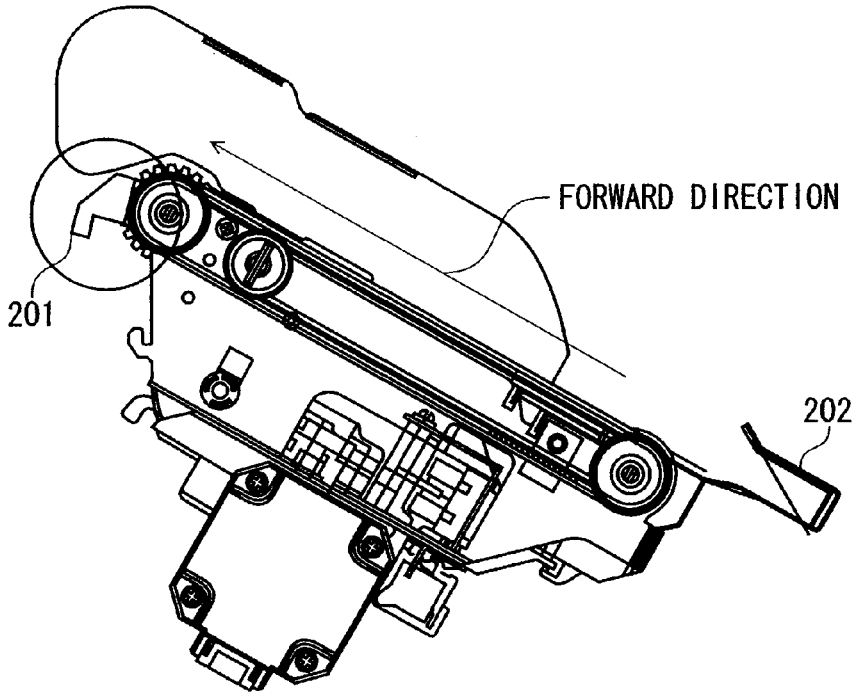
FIG. 19A is a view showing a stop position of a bundle hook if the number of stacked sheet bundles after stapling is a reference value or less.
Figure 19B:
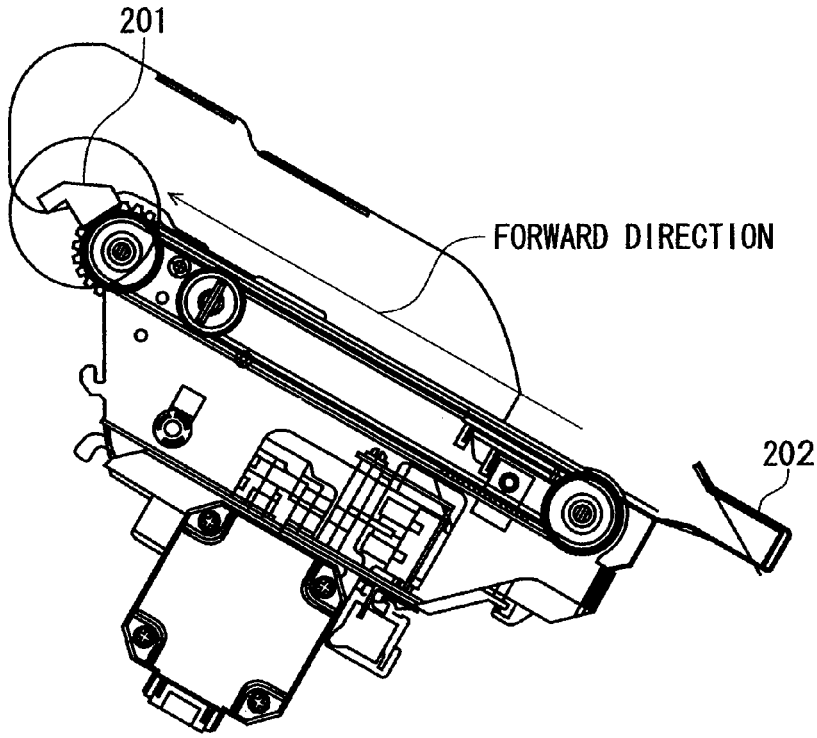
FIG. 19B is a view showing a stop position of the bundle hook when the number of stacked sheet bundles after stapling is larger than the reference value.

FIG. 19A shows the stop position of the bundle hook 201 if the number of stacked sheet bundles after stapling is the reference value or less. FIG. 19B shows the stop position of the bundle hook 201 if the number of stacked sheet bundles after stapling is larger than the reference value. The stop of the bundle hook 210 corresponds to the drive stop of the bundle hook belt at Act 8 in the case of FIG. 13. Specifically, as shown in FIGS. 19A and 19B, as compared with the stop position of the bundle hook 201 if the number of stacked sheet bundles after stapling is the reference value or less, the stop position of the bundle hook 201 if the number of stacked sheet bundles after stapling is larger than the reference value is set to an upstream side in the traveling direction (forward direction). That is, in the finisher 120 of the second embodiment, as compared with the stop position of the bundle hook 201 if the number of stacked sheet bundles after stapling is the reference value or less, the stop position of the bundle hook 201 if the number of stacked sheet bundles after stapling is larger than the reference value is set to the position where the amount of rotation of the bundle hook 201 in the rotation portion M is small. In the finisher 120 of the second embodiment, it is possible to prevent that the sheet bundle after stapling can not return to the wall of the shutter section 10 and the sheet bundle after stapling is stacked stepwise. Besides, in the finisher 120 of the second embodiment, it is possible to prevent that the sheet bundle slides down in the opposite direction to the shutter section 10 side.

The finisher 120 of the second embodiment can be applied not only to the case where the stapler 164 staples the sheet bundle at one place, but also to the case where the stapler 151 staples the sheet bundle at two places.

Third Embodiment

Figure 20:
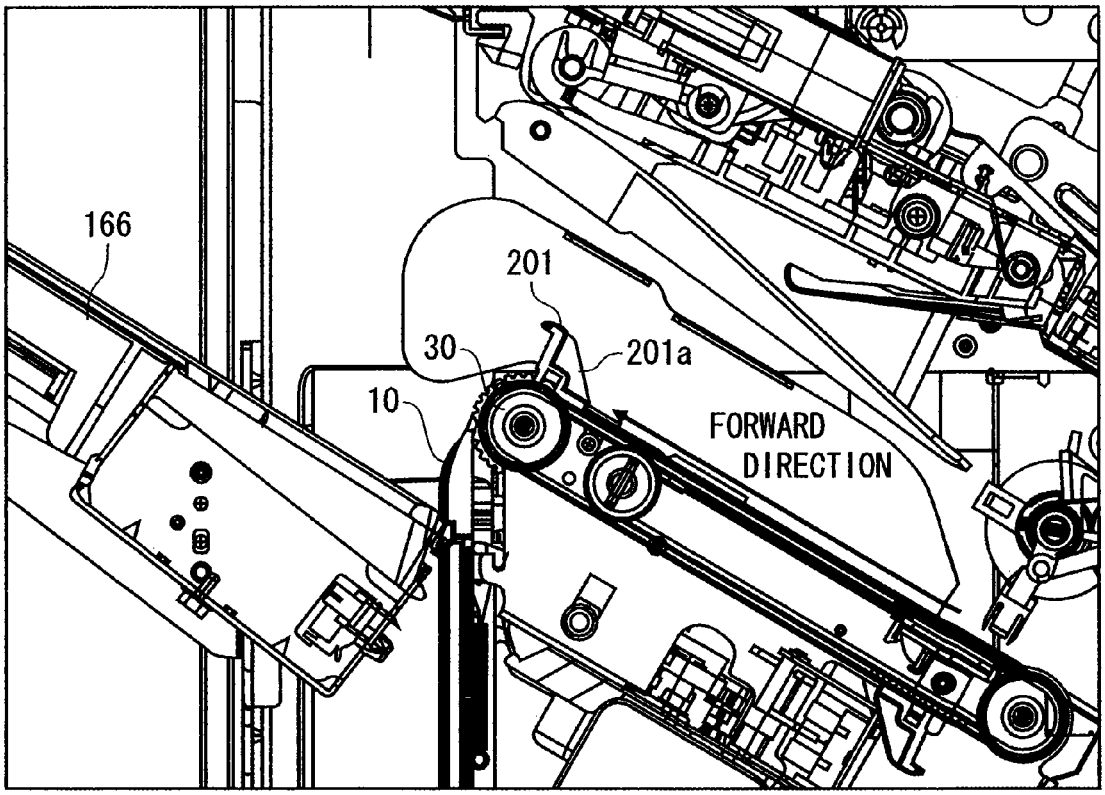
FIG. 20 is a view showing state where the finisher discharges a sheet bundle to a storage tray by both a bundle hook and a discharge roller.

FIG. 20 shows a state where the finisher 120 discharges a sheet bundle to the storage tray 166 by both the bundle hook 201 and the discharge rollers 30. As shown in FIG. 20, both the bundle hook 201 and the discharge rollers 30 discharge the sheet bundle to the storage tray 166. After the bundle hook 201 and the discharge rollers 30 push out the sheet bundle to the storage tray 166, the bundle hook 201 temporarily stops and starts to be driven in the reverse direction, and returns to the home position. At the time point if the bundle hook 201 starts to be driven in the reverse direction, the discharge rollers 30 pushes out the trailing edge of the sheet bundle to the storage tray 166. However, after rotating in the forward direction to push out the trailing edge of the sheet bundle to the storage tray 166, the discharge rollers 30 immediately start to rotate in the reverse direction in order to vertically align a following sheet bundle. Since the discharge rollers 30 rotates in the reverse direction, if the curl amount of the sheet bundle is larger than a reference value, there is a case where the sheet discharged by the discharge rollers 30 reversely flows into the processing tray 163 by the rotation of the discharge rollers 30 in the reverse direction.

Figure 21:
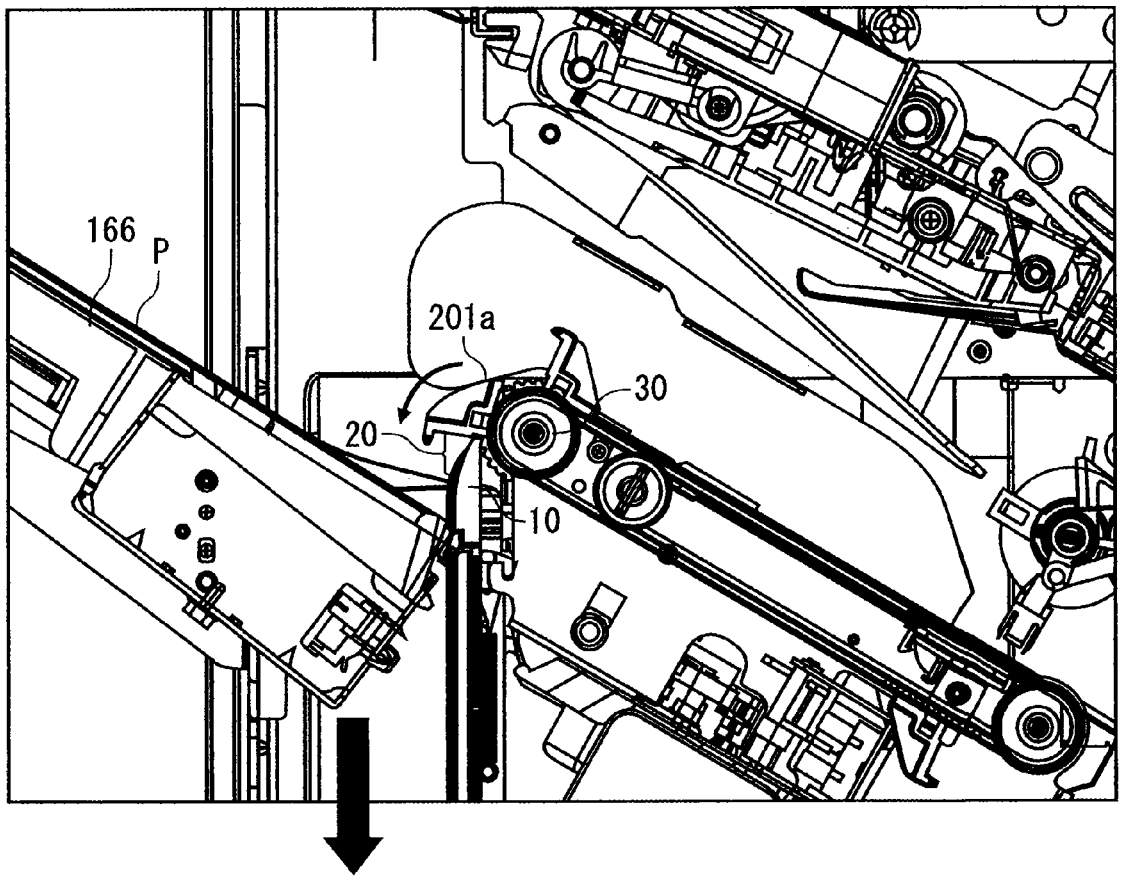
FIG. 21 is a view showing a method according to a third embodiment in which a press member of a shutter section urges a trailing edge of a discharged sheet bundle downward.

In the finisher 120 of the third embodiment, as shown in FIG. 21, if the storage tray 166 starts to lower in an arrow direction after the discharge rollers 30 discharge the sheet bundle, the bundle hook 201 rotates in the rotation portion M in accordance with the amount of lowering of the storage tray 166 while reducing the drive speed, and certainly drops the trailing edge of the sheet bundle to the position of the press member 1 of the shutter section 10. The press member 1 of the shutter section 10 urges the trailing edge of the discharged sheet bundle downward. Since The press member 1 of the shutter section 10 urges the trailing edge of the discharged sheet bundle downward, in the finisher 120 of the third embodiment, it is possible to prevent that the sheet discharged by the discharge rollers 30 reversely flows into the processing tray 163. In the third embodiment, since the structures of FIG. 1 to FIG. 12 are not changed, the description about FIG. 1 to FIG. 12 is omitted to avoid repetition. Besides, it is assumed that the finisher 120 of the third embodiment executes the bundle hook belt drive control process shown in FIG. 13 similarly to the first embodiment. The finisher 120 of the third embodiment may execute the bundle hook belt drive control process shown in FIG. 15 similarly to the first embodiment. Of course, the finisher of the third embodiment can be applied to the case where the bundle hook belt drive control process shown in FIG. 13 or FIG. 15 is not executed.

Figure 22:
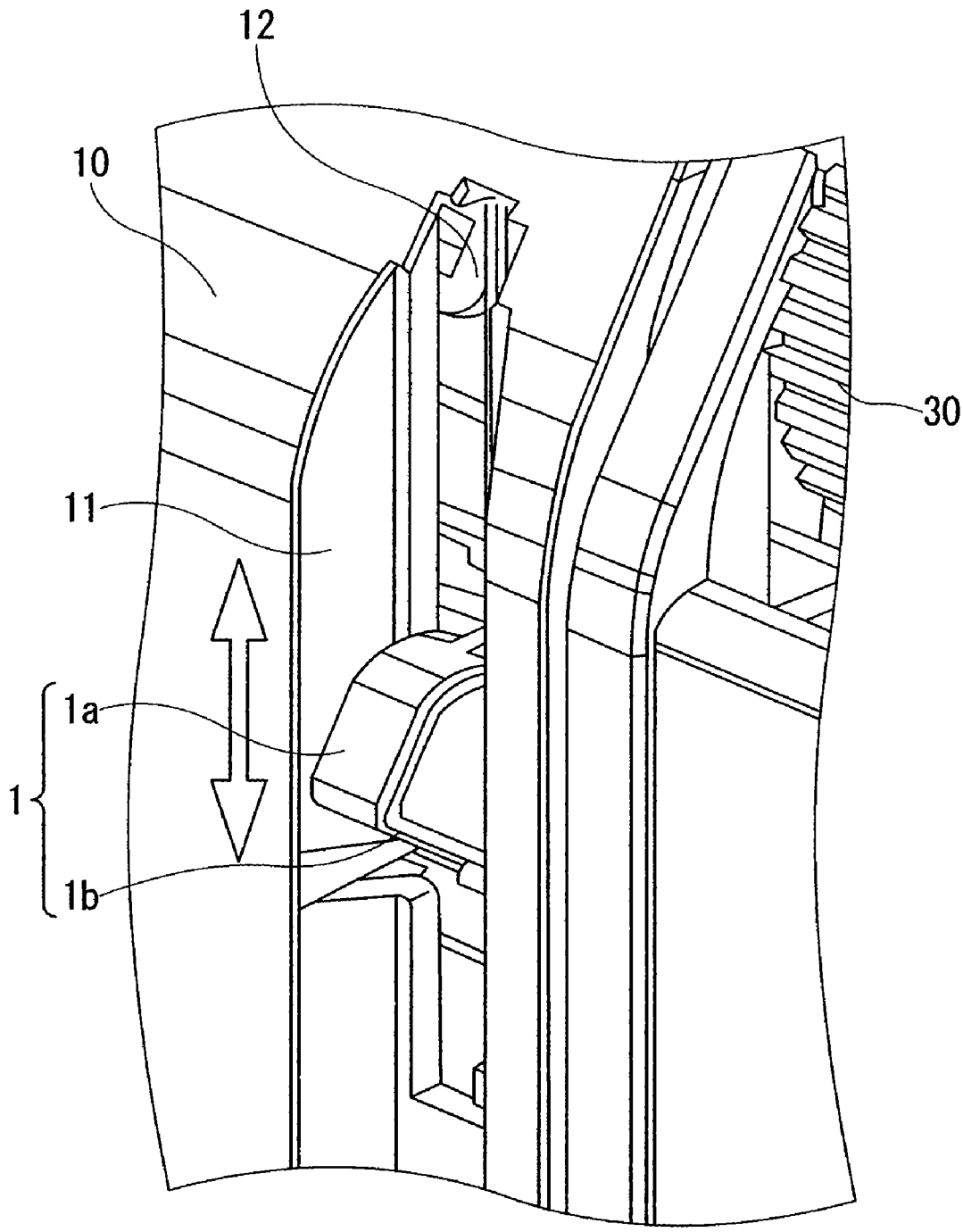
FIG. 22 is an enlarged perspective view of the press member of the shutter section.

FIG. 22 is an enlarged perspective view of the press member 1 of the shutter section 10. The shutter section 10 has a recess 11. The shutter section 10 has an opening 12 at the bottom of the recess 11. The press member 1 protrudes from the opening 12. The press member 1 includes a head section 1*a* and a press section 1*b* protruding from the surface of the shutter section 10. The press member 1 can move in the recess 11 in an up-and-down direction indicated by an arrow within the range where the uppermost section of the head section 1*a* and the lowermost section of the press section 1*b* respectively contact with the upper limit and the lower limit of the opening 12. The press section 1*b* has such an angle that the press section 1*b* is substantially parallel to the surface of the storage tray 166. The press member 1 moves in the up-and-down direction while keeping such an angle that the press section 1*b* is substantially parallel to the surface of the storage tray. The press member 1 is urged downward. If the storage tray 166 is merely raised, the press member 1 can press the trailing edge of the sheet on the storage tray 166 substantially vertically to the surface of the storage tray 166. If the shutter section 10 is merely lowered, the press member 1 may press the trailing edge of the sheet on the storage tray 166 substantially vertically to the surface of the storage tray 166. A member such a rubber having high friction coefficient is provided on the surface of the press section 1*b*. By the member having high friction coefficient, the press effect of the press member 1 to the trailing edge of the sheet is accelerated.

Figures 23A, 23B:
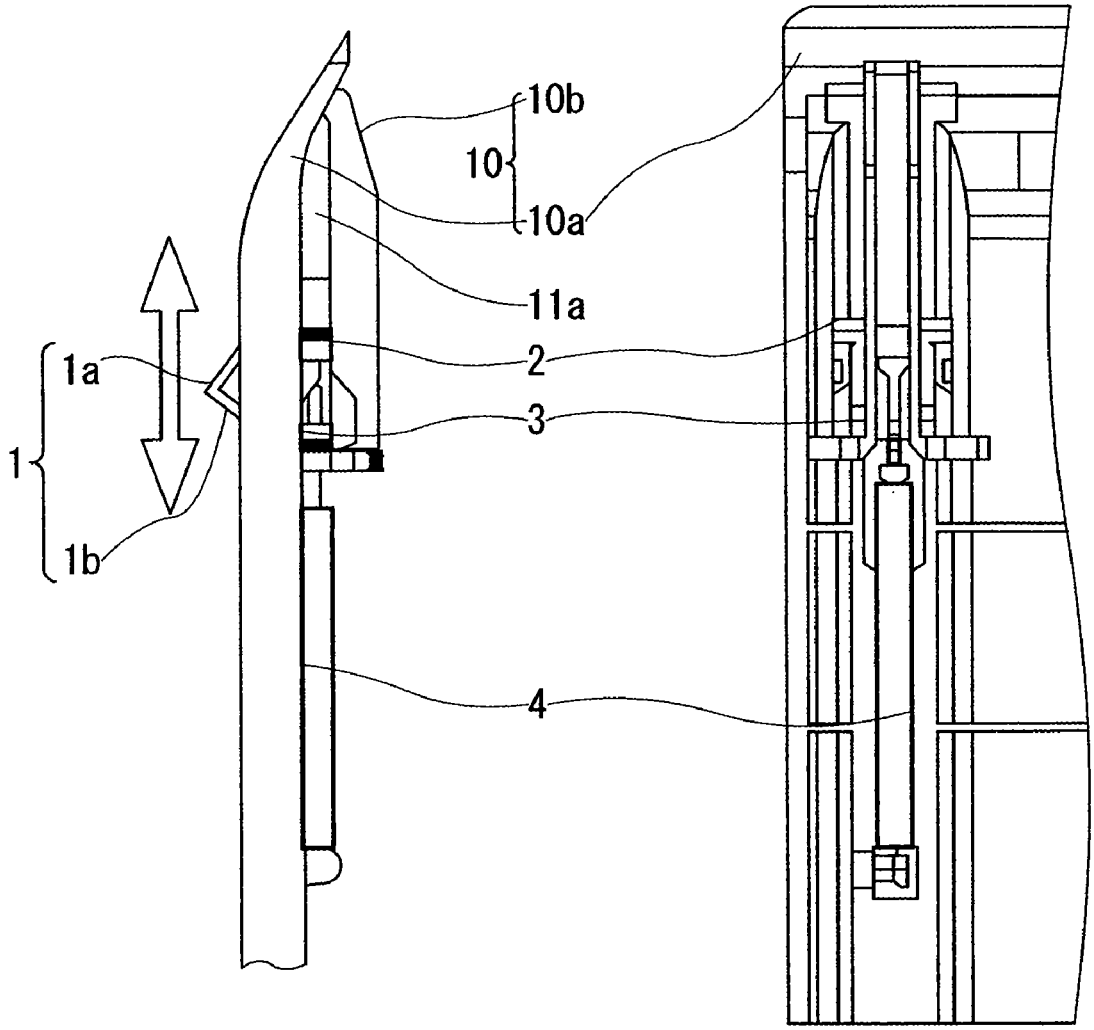
FIG. 23A is a sectional view, seen from a side surface, showing a structure of the press member.
FIG. 23B is a sectional view, seen from a back surface, showing the structure of the press member.

FIG. 23A is a sectional view, seen from a side surface, showing a structure of the press member 1. FIG. 23B is a sectional view, seen from aback surface, showing the structure of the press member 1. The shutter section 10 includes a shutter front face section 10*a*, a shutter back face section 10*b*, and a guide groove 11*a*. The shutter section 10 includes the guide groove between the shutter front face section 10*a* and the shutter back face section 10*b*. The shutter section 10 includes a first guide pin 2 and a second guide pin 3 in the inside of the guide groove 11*a* of the press member 1. The guide groove 11*a* has an interval in which the first guide pin 2 and the second guide pin 3 can slide. The first guide pin 2 and the second guide pin 3 slide in the guide groove 11*a*, so that the press member 1 can move in the up-and-down direction while keeping such an angle that the press member 1*b* is substantially parallel to the surface of the storage tray 166.

One end of a spring 4 connects to the lowermost part of a portion of the press member 1 located in the guide groove 11*a*. The other end of the spring 4 connects to a back face lower part of the shutter front face section 10*a*. Since the other end of the spring 4 connects to a back face lower part of the shutter front face section 10*a*, if the press member 1 moves in the up-and-down direction, the spring 4 urges the press member 1 downward. In the case of the third embodiment, a coil spring may be used instead of the spring 4.

Figure 24:
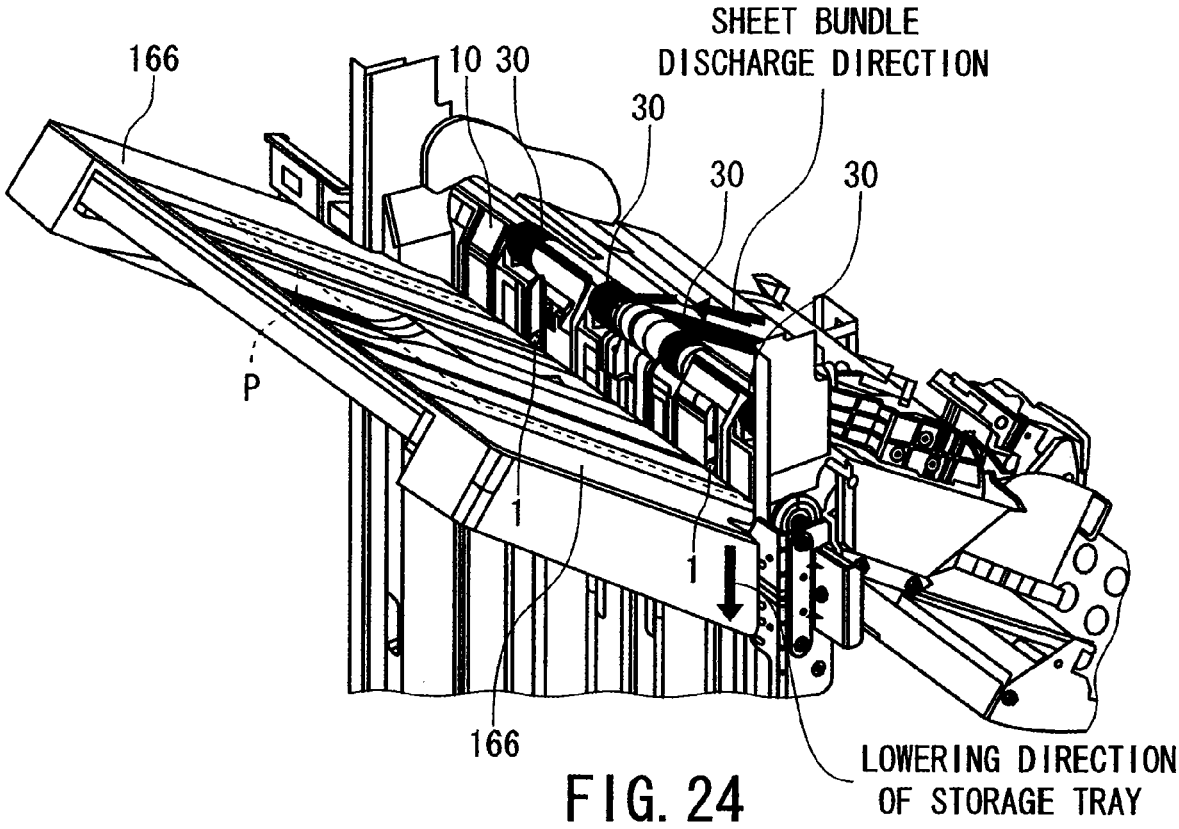
FIG. 24 is a view showing a holding method of a trailing edge of a sheet bundle in a finisher of the third embodiment.
Figure 25:
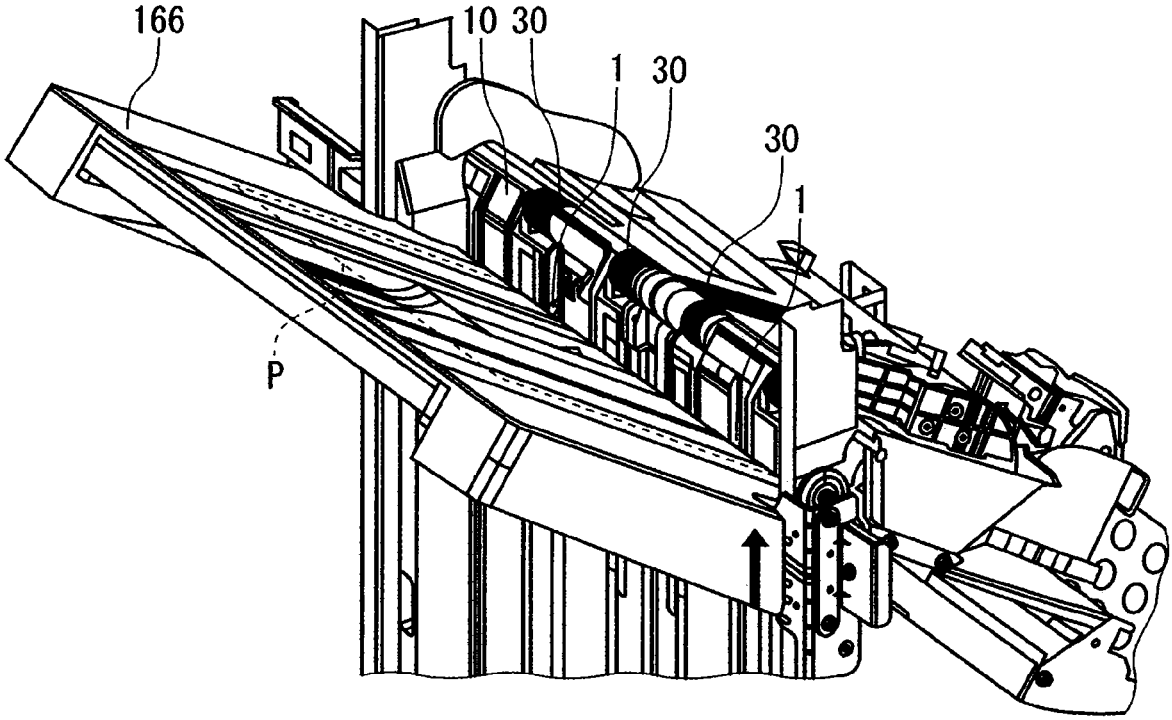
FIG. 25 is a view showing the holding method of the trailing edge of the sheet bundle in the finisher of the third embodiment.
Figure 26:
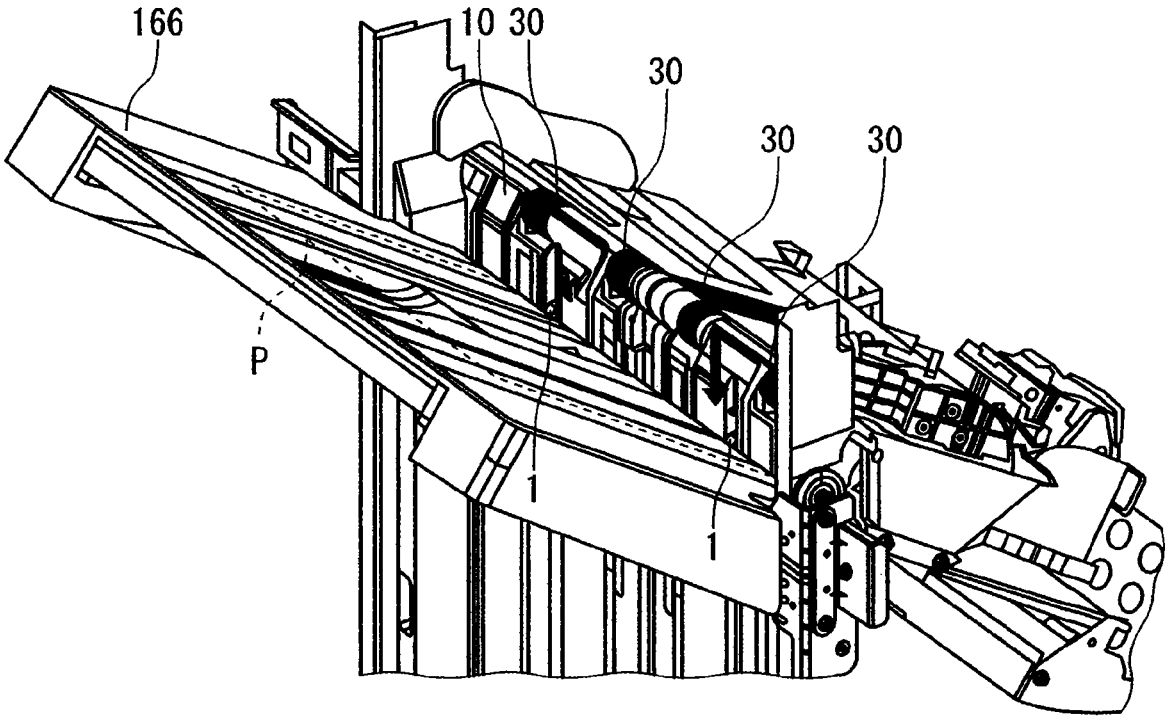
FIG. 26 is a view showing the holding method of the trailing edge of the sheet bundle in the finisher of the third embodiment.

FIG. 24 to FIG. 26 show a method of holding a trailing edge of a sheet bundle in the finisher 120 of the third embodiment. As shown in FIG. 24, after the bundle hook 201 and the discharge rollers 30 discharge the sheet bundle to the storage tray 166, the storage tray 166 starts to lower. By the lowering of the storage tray 166, the upper surface of the sheet bundle lowers to a position lower than the lower limit position of the movable range of the press member 1. As shown in FIG. 25, the storage tray 166 starts to rise after lowering. Since the storage tray 166 starts to rise after lowering, as shown in FIG. 26, the finisher 120 of the third embodiment can hold the trailing edge of the sheet bundle between the press member 1 and the storage tray 166.

Figure 27A:
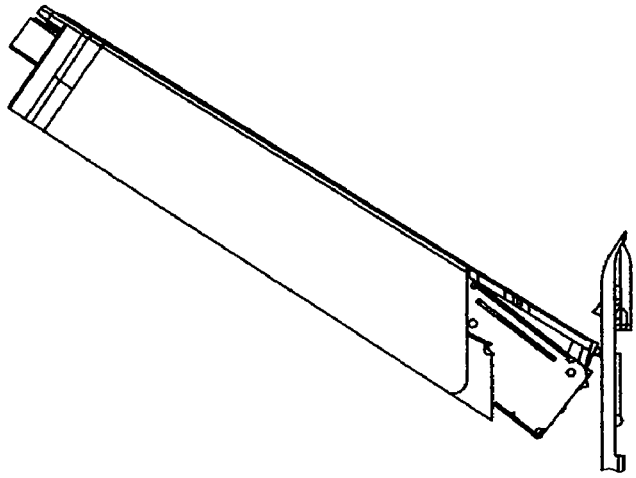
FIGS. 27A to 27C are sectional views of the press member if the finisher of the third embodiment holds the trailing edge of the sheet bundle.
Figure 27B:
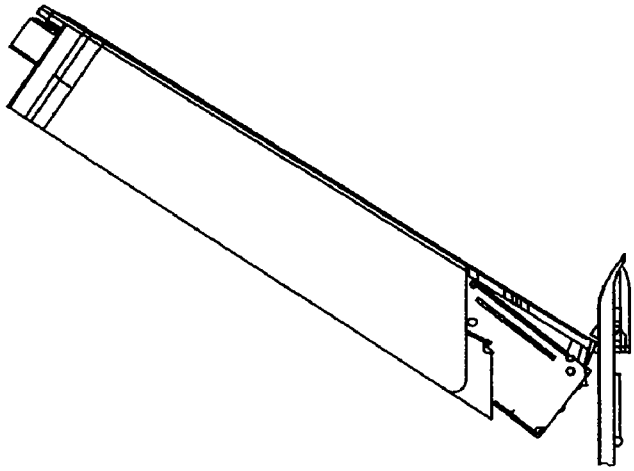
Figure 27C:
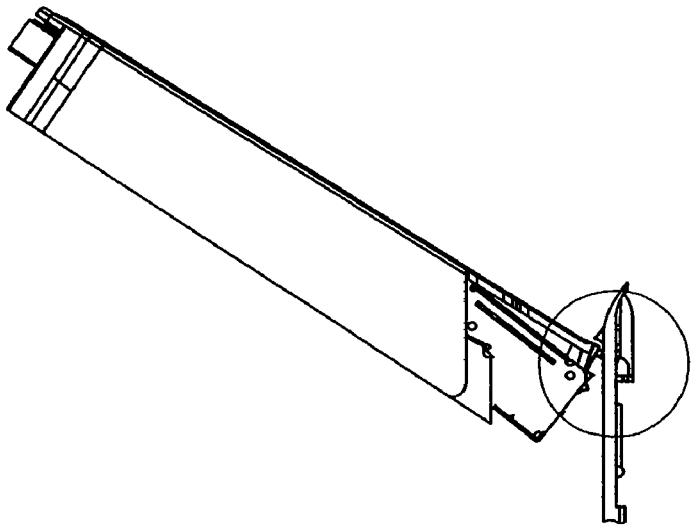

FIGS. 27A to 27C are sectional views of the press member 1 when the finisher 120 of the third embodiment holds the trailing edge of the sheet bundle. As shown in FIG. 27A, in the finisher 120 of the third embodiment, the storage tray 166 is once lowered after discharge of the sheet bundle in order to hold the trailing edge of the sheet bundle. As shown in FIGS. 27B and 27C, the finisher 120 of the third embodiment holds the trailing edge of the sheet bundle between the press member 1 and the storage tray 166. In both FIG. 27B and FIG. 27C, the finisher 120 of the third embodiment holds the trailing edge of the sheet bundle between the press member 1 and the storage tray 166. However, since the standby position of the storage tray 166 varies according to the kind of a sheet, a print job and a finishing method, the position where the finisher 120 of the third embodiment holds the trailing edge of the sheet bundle between the press member 1 and the storage tray 166 is different between FIGS. 27B and 27C.

Figure 28:
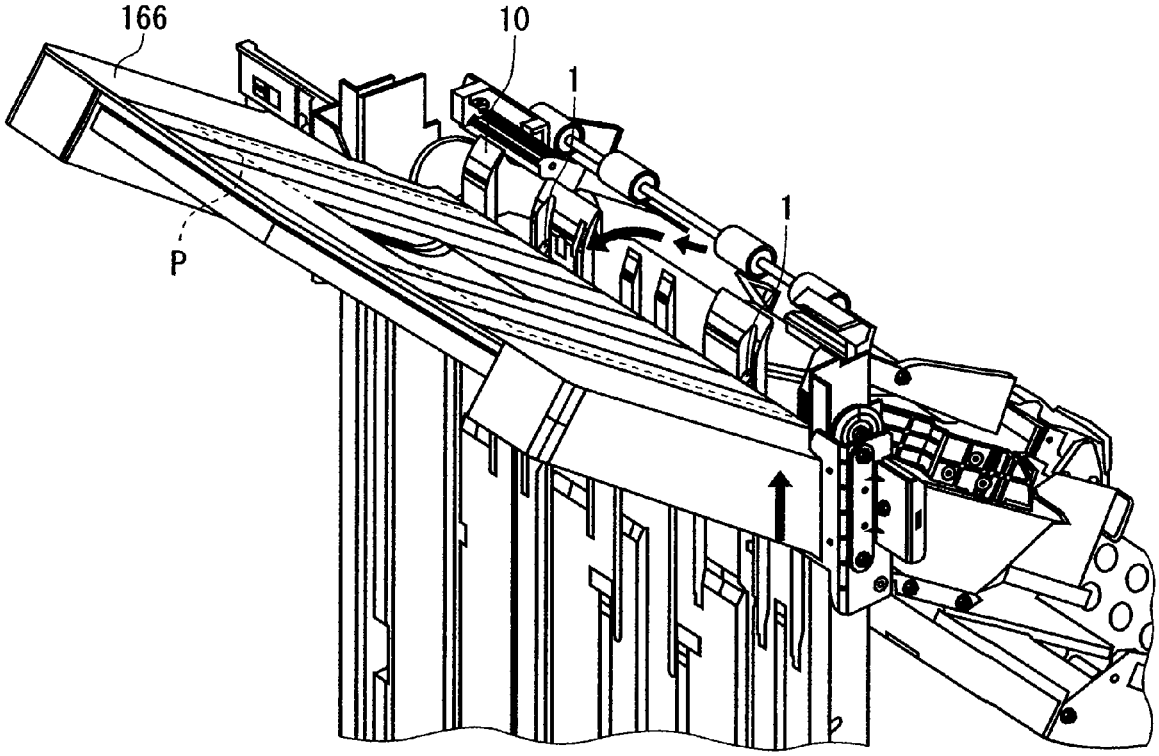
FIG. 28 is a view showing a state in which the finisher of the third embodiment holds a sheet bundle when the finisher of the third embodiment raises a shutter section in the case where the finisher of the third embodiment discharges the sheet bundle from a discharge port different from a discharge port of FIG. 24 to FIG. 27.

FIG. 28 shows a state where the finisher 120 of the third embodiment holds a sheet bundle when the finisher 120 of the third embodiment raises the shutter section 10 if the finisher 120 of the third embodiment discharges the sheet bundle from a discharge port different from that of FIG. 24 to FIG. 27. As shown in FIG. 28, if the finisher 120 of the third embodiment discharges the sheet bundle from the discharge port different from that of FIG. 24 to FIG. 27, the finisher 120 of the third embodiment raises the shutter section 10, and raises also the storage tray 166 in accordance with the discharge port. If the finisher 120 of the third embodiment raises the shutter section 10, and raises also the storage tray 166 in accordance with the discharge port, the press member 1 also rises with the rising of the shutter section 10.

Figure 29:
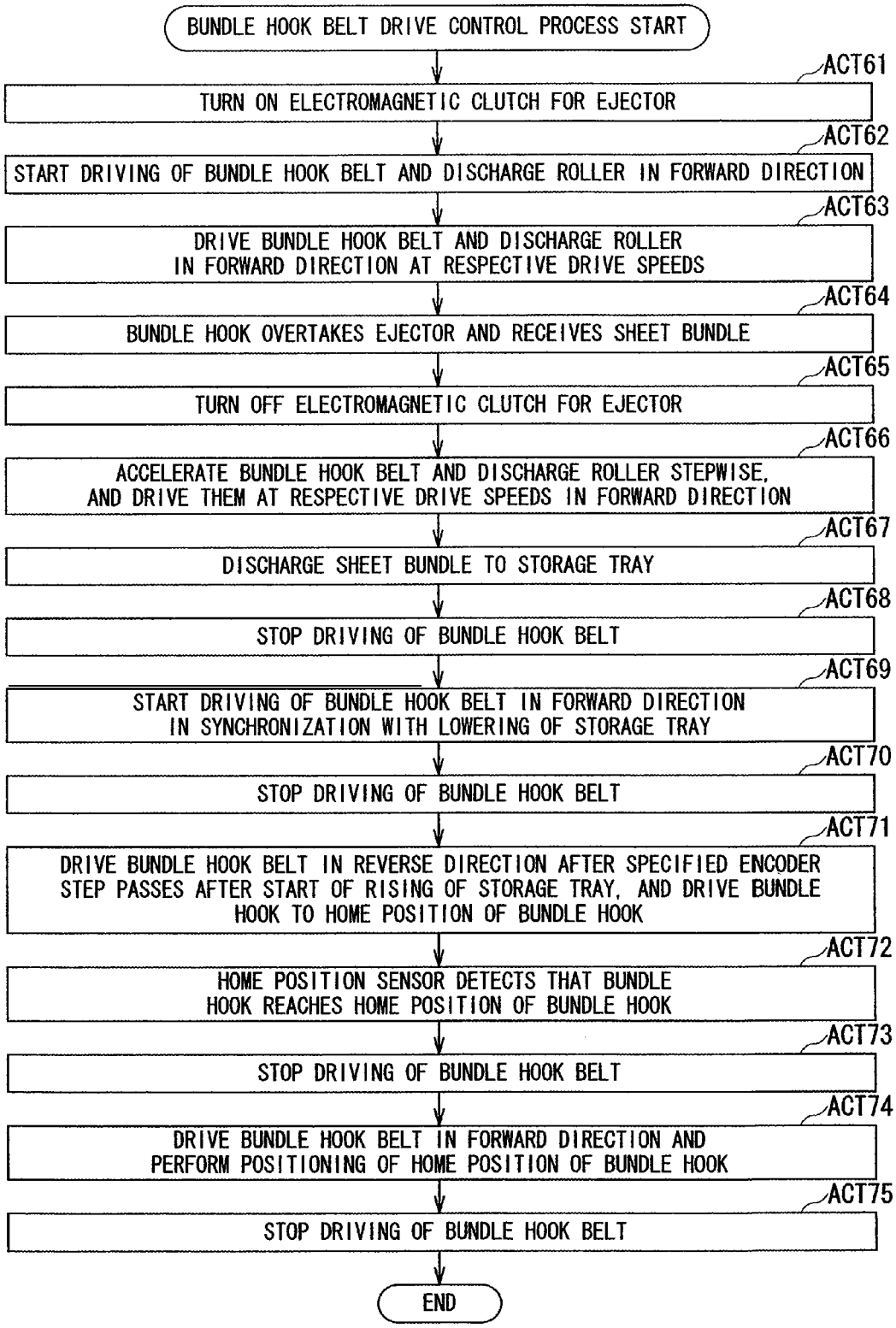
FIG. 29 is a flowchart for explaining a bundle hook belt drive control process in the finisher of the third embodiment.
Figure 30:
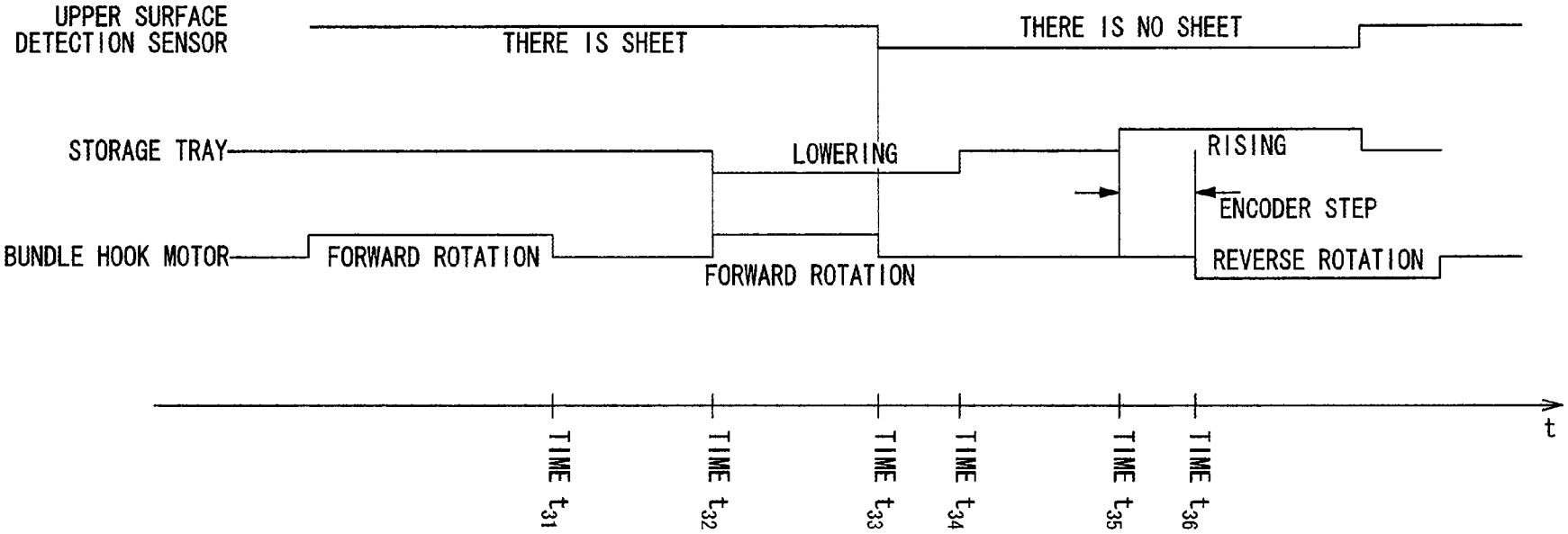
FIG. 30 is a timing chart of a bundle hook motor and a home position sensor if the finisher executes the bundle hook belt drive control process of FIG. 29.

A bundle hook belt drive control process in the finisher 120 of the third embodiment will be described with reference to a flowchart of FIG. 29. FIG. 30 is a timing chart of a bundle hook motor and a home position sensor 203 when the bundle hook belt drive control process of FIG. 29 is executed. Since Act 61 to Act 68 and Act 72 to Act 75 of FIG. 29 are the same as Act 1 to Act 8 and Act 10 to Act 13 of FIG. 13, the description about Act 61 to Act 68 and Act 72 to Act 75 is omitted to avoid repetition.

At Act 68, the CPU 221 controls the driver 225, stops driving of the bundle hook motor at time $t_{31}$, and once stops driving of the bundle hook belt 50 from time $t_{31}$ to time $t_{32}$. After the driving of the bundle hook belt 50 is stopped at Act 68, at Act 69, the CPU 221 controls the driver 225, drives the storage tray motor at time $t_3$ to start lowering of the storage tray 166, drives the bundle hook motor in the forward direction at time $t_3$, and drives the bundle hook 201 of the bundle hook belt 50 in synchronization with the lowering of the storage tray 166. The bundle hook 201 starts to be driven in the forward direction from the once stopped position, and starts rotation in the rotation portion M. If the bundle hook 201 starts rotation in the rotation portion M, since the lowering amount of the storage tray 166 is almost the same as that of the bundle hook 201, the bundle hook 201 does not apply superfluous pressure to the sheet on the storage tray 166. The bundle hook 201 certainly drops the sheet bundle to the position of the press member 1. At Act 70, the CPU 221 controls the driver 225, stops the driving of the bundle hook motor at time $t_{33}$, and once stops the driving of the bundle hook belt 50 from $t_{33}$ to $t_{36}$. The press member 1 of the shutter section 10 urges the trailing edge of the discharged sheet bundle downward. If the press member 1 of the shutter section 10 urges the trailing edge of the discharged sheet bundle downward, a sheet upper surface sensor 80 detects that there is no sheet.

The storage tray 166 is lowered by the storage tray motor until time $t_{31}$, and the lowering is stopped at time $t_{34}$. The storage tray 166 starts to rise at time $t_{35}$ by the storage tray motor. At Act 71, the CPU 221 controls the driver 225, drives the bundle hook motor in the reverse direction at time $t_{36}$ after a required encoder step passes from the start of rising of the storage tray 166, and drives the bundle hook 201 of the bundle hook belt 50 to the home position of the bundle hook 201. After the bundle hook 201 moves to the home position, the bundle hook 201 performs a return operation.

The finisher 120 of the third embodiment can hold the trailing edge of the sheet bundle between the press member 1 and the storage tray 166, and it is possible to prevent that the sheet discharged by the discharge rollers 30 reversely flows into the processing tray 163 by the rotation of the discharge rollers 30 in the reverse direction.

Although the series of processes described in the embodiments can be executed by software, hardware, or a combination of software and hardware.

Besides, in the embodiments, although the example of the process is described in which the operations of the flowchart are performed in time series along the recited sequence, they may not be performed in time series, and a process in which the operations are executed in parallel or individually is also included.

What is claimed is:

1. A bundle hook discharge device comprising:

a bundle hook configured to push a sheet bundle in a first direction and convey the sheet bundle;

a drive unit configured to drive the bundle hook in the first direction and a second direction;

a discharge unit configured to discharge the sheet bundle conveyed by the bundle hook;

a stacking unit configured to stack the sheet bundle discharged by the discharge unit; and a control unit configured to control the drive unit to drive the bundle hook in the second direction when a sheet jam does not occur after the drive unit drives the bundle hook in the first direction and the discharge unit discharges the sheet bundle, and to control the drive unit to drive the bundle hook in the first direction when a sheet jam occurs after the drive unit drives the bundle hook in the first direction and the discharge unit discharges the sheet bundle.

2. The device of claim 1, wherein the first direction is a conveying direction of the sheet bundle, and the second direction is a reverse direction to the conveying direction of the sheet bundle.

3. The device of claim 1, further comprising a detection unit configured to detect a position of the bundle hook, wherein the control unit controls the drive unit to decelerate driving of the bundle hook when the detection unit detects the position of the bundle hook.

4. The device of claim 3, wherein the bundle hook has a detection member at a rear end of the bundle hook, and the control unit controls the drive unit to stop driving of the bundle hook when the detection unit detects the detection member after the driving of the bundle hook is decelerated.

5. The device of claim 3, wherein the detection unit is a transmission sensor or an actuator sensor.

6. An image forming apparatus comprising:

an image forming unit configured to form an image on a sheet;

a bundle hook configured to push a sheet bundle in a first direction and convey the sheet bundle;

a drive unit configured to drive the bundle hook in the first direction and a second direction;

a discharge unit configured to discharge the sheet bundle conveyed by the bundle hook;

a stacking unit configured to stack the sheet bundle discharged by the discharge unit; and a control unit configured to control the drive unit to drive the bundle hook in the second direction when a sheet jam does not occur after the drive unit drives the bundle hook in the first direction and the discharge unit discharges the sheet bundle, and to control the drive unit to drive the bundle hook in the first direction when a sheet jam occurs after the drive unit drives the bundle hook in the first direction and the discharge unit discharges the sheet bundle.

7. The apparatus of claim 6, wherein the first direction is a conveying direction of the sheet bundle, and the second direction is a reverse direction to the conveying direction of the sheet bundle.

8. The apparatus of claim 6, further comprising a detection unit configured to detect a position of the bundle hook, wherein the control unit controls the drive unit to decelerate driving of the bundle hook when the detection unit detects the position of the bundle hook.

9. The apparatus of claim 8, wherein the bundle hook has a detection member at a rear end of the bundle hook, and the control unit controls the drive unit to stop driving of the bundle hook when the detection unit detects the detection member after the driving of the bundle hook is decelerated.

10. The apparatus of claim 8, wherein the detection unit is a transmission sensor or an actuator sensor.

* * * * *